US005213333A

United States Patent [19]

Petrovich et al.

[11] Patent Number: 5,213,333

[45] Date of Patent: May 25, 1993

[54] WORD ASSOCIATION GAME

[76] Inventors: Joseph J. Petrovich, 306 Green Acres Dr., Valparaiso, Ind. 46383; James D. Gazdick, 451 Spivak Dr., Schererville, Ind. 46375

[21] Appl. No.: 706,980

[22] Filed: May 29, 1991

[51] Int. Cl.[5] ..... A63F 3/00

[52] U.S. Cl. ..... 273/243; 273/272

[58] Field of Search ..... 273/240, 242, 243, 272

[56] References Cited

U.S. PATENT DOCUMENTS

| | | | |
|---|---|---|---|
| 2,602,667 | 7/1952 | Poarch | 273/243 |
| 3,389,480 | 6/1968 | Holland | 273/272 |
| 3,606,336 | 5/1968 | Krause . | |
| 4,053,154 | 10/1977 | Niemann | 273/243 |
| 4,089,527 | 5/1978 | Roth . | |
| 4,340,231 | 7/1982 | Cammarata | 273/243 |
| 4,666,161 | 5/1987 | Elesie et al. . | |
| 4,671,516 | 6/1987 | Lizzola | 273/243 X |
| 4,854,594 | 8/1989 | Eaton . | |
| 4,884,815 | 12/1989 | Glenn . | |
| 4,911,452 | 3/1990 | Marchese, Jr. . | |
| 4,941,668 | 7/1990 | Mobrem . | |
| 4,955,614 | 9/1990 | Buda . | |
| 5,004,244 | 4/1991 | Johnson | 273/240 |

OTHER PUBLICATIONS

Trival Pursuit, "Master Game Rules of Play", Selchow & Righter Co., 1981.

*Primary Examiner*—William H. Grieb

*Assistant Examiner*—William E. Stoll

*Attorney, Agent, or Firm*—Patula & Associates

[57] ABSTRACT

A word association game wherein the players derive different but commonly known word sets from elements of a previous commonly known set including a die, a board, a plurality of preprinted cards, a "minute glass" timer, a plurality of pads and writing instruments, and game tokens for movement on the board. The board has a path of adjacent spaces, which path is arranged in a FIG. 8 with the start space at the crossing. The spaces are color coded in one of six different colors. The preprinted cards each have a blind side and a face side. The latter has six different color coded areas with a different word set in each. A word set is a common phrase (e.g. TIE CLASP) or single (e.g. BLACKJACK) which includes a plurality of different word elements (e.g. TIE, CLASP, BLACK, JACK). Each card has different word sets from the other cards with those of one color coding being of a different word sets from the other categories: PEOPLE, PLACES, TITLES, THINGS, GENERAL and SPORTS/GAMES. A player's turn includes throwing a die and drawing a card at random. The player's piece is moved the number of spaces on the die to a space whose color code determines the category and thus the starting word set. The player must in a time period enter successive word sets on the score pad, each entry related to the previous word set by using one of its elements for points and/or movement of tokens. Players alternate turns until one reaches a set goal (e.g. 100 points).

5 Claims, 2 Drawing Sheets

WORD ASSOCIATION GAME

FIELD OF THE INVENTION

This invention relates to a novel word association game for two or more players.

BACKGROUND OF THE INVENTION

Word games provide amusement and education. Many of such games, for example, that disclosed in U.S. Pat. No. 4,854,594 to Eaton, employ a board wherein players move tokens about a board and answer trivia questions related to the space upon which their tokens land. Another game employing trivia questions is disclosed in U.S. Pat. No. 4,884,815 to Glenn, which game also employs decoding a number to letters which are rearranged by the players into words. Others, such as U.S. Pat. No. 4,666,161, Elesie, et al., employ a track or pathway on a board and have players draw cards with words and definitions, and wherein players advance by knowing the correct definition of drawn words. In other word games, such as that shown in U.S. Pat. No. 4,089,527, to Roth, a player advances by memorizing items on cards. Word puzzles are involved in the game of U.S. Pat. No. 4,941,668, to Mobrem, and U.S. Pat. No. 4,911,452 to Marchese requires players to name a series of words which fit within a particular category and start with particular letters. U.S. Pat. No. 4,955,614 to Buda involves guessing particular words by a process of selecting and eliminating letters contained in the word. And U.S. Pat. No. 3,606,336 to Krause is directed to a word association game wherein the player builds words from lettered tiles obeying the rule that successive words start from the last letter of the prior word and have a length derived from chance.

Clever and as educational as these games and others like them may be, there is still room for additional educational and entertaining word games, and especially for one which does not rely on knowledge of definitions, trivia facts, or short time memorization of patterns or items, but instead develops and rewards free association.

SUMMARY OF THE INVENTION

A word association game in accordance with the present invention includes a recorded data base of a plurality of different commonly known word sets (such as TIE CLASP or BLACKJACK), each of which includes a plurality of word elements (such as TIE, CLASP, BLACK, and JACK). Means for randomly selecting one of these word sets (e.g. BLACKJACK) is provided, as well as timing means and means for recording a sequence of word sets, starting from the one which, to count toward winning, must be commonly known, and sets employing one word element (e.g. JACK FROST, FROST BITE, BITE THE BULLET, BULLET TRAIN) from the preceding word set of the sequence. A player (or team) advances relative to his competitors by recording word sets in a sequence in a set period, and thus the game rewards and encourages quick wit and free association of commonly known phrases or word sets.

The invention, together with further advantages and features thereof, may best be understood by reference to the following description taken in connection with the accompanying drawings, in the several figures of which like reference numerals identify like elements.

DETAILED DESCRIPTION OF ONE PREFERRED EMBODIMENT

Figure 1:
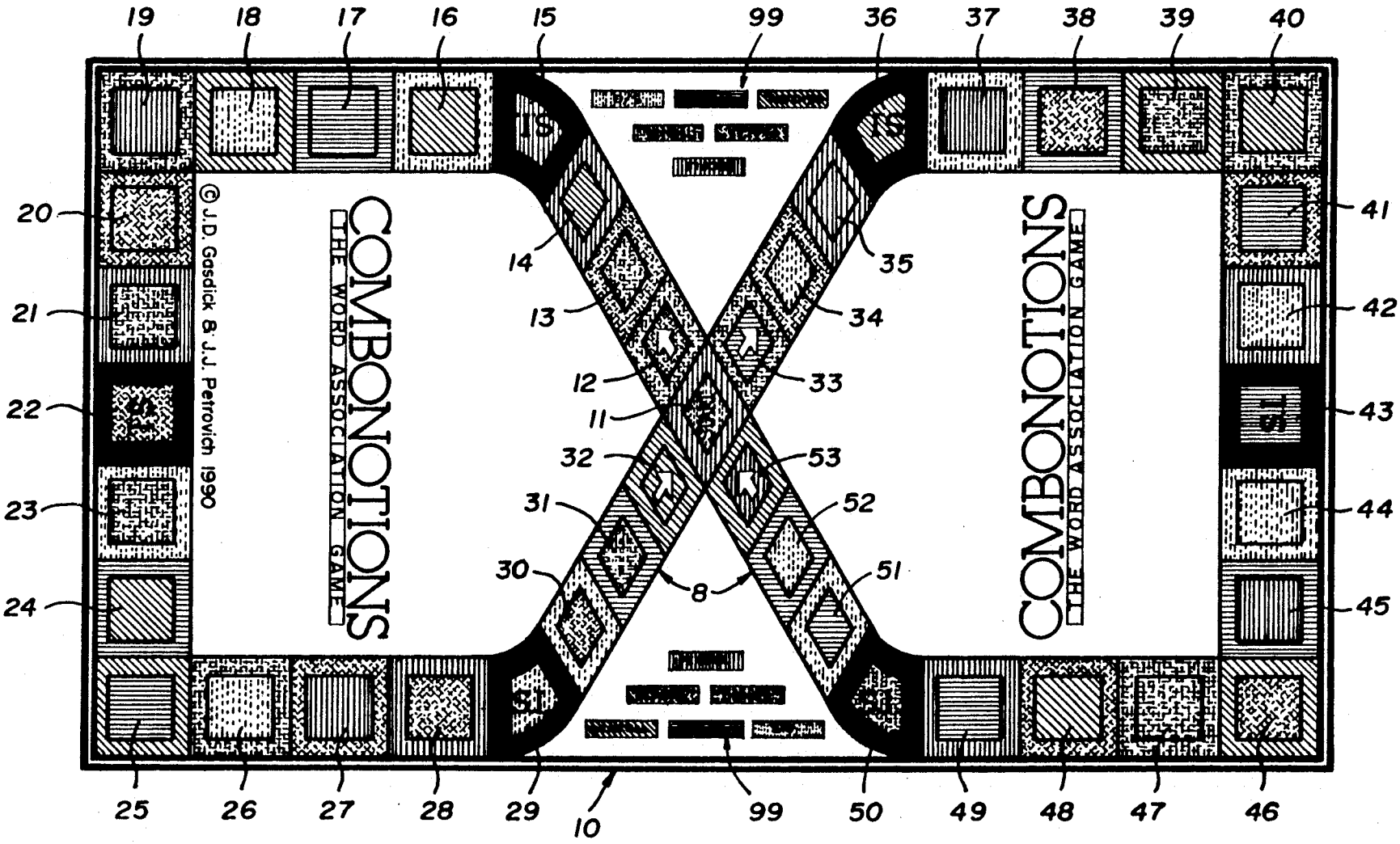
FIG. 1 is a plan view of a preferred embodiment of a game board constructed in accordance with the present invention.

Referring to FIG. 1, there is depicted a board 10 having a plurality of spaces 11–53 arranged in a path or track 8 which is laid out in the general shape of a FIG. 8. Each of the 43 individual spaces has its center color coded in one of six colors: red, green, blue, yellow, orange or purple. The cross-over space 11 serves as the "start" and is so labeled. A player or team of players chooses a token (such as one of the six tokens 61–66 of FIG. 2) which for ease of identification are differentiated from each other by color (different tokens 61–66 being red, blue, orange, green, yellow or purple).

The direction of travel on the path 8 is one-way in the directions of the arrows shown on spaces 12, 32, 33 and 53. The only choice of direction is upon leaving "start" space 11, and that is preferably the choice of the player or team. Once committed, the token travels the FIG. 8 track 8 going by the cross-over space 11 in a straight line form space 53 to space 12 or form space 32 to space 33.

Six of the spaces, i.e. spaces 15, 22, 29, 36, 43 and 50, have indicia on them ("SI") which sets them off from the majority of the spaces 11–53. These spaces have special instructions associated with them, and tokens landing on them requires the player to follow those instructions, which will be explained below under "Rules."

Figure 2:
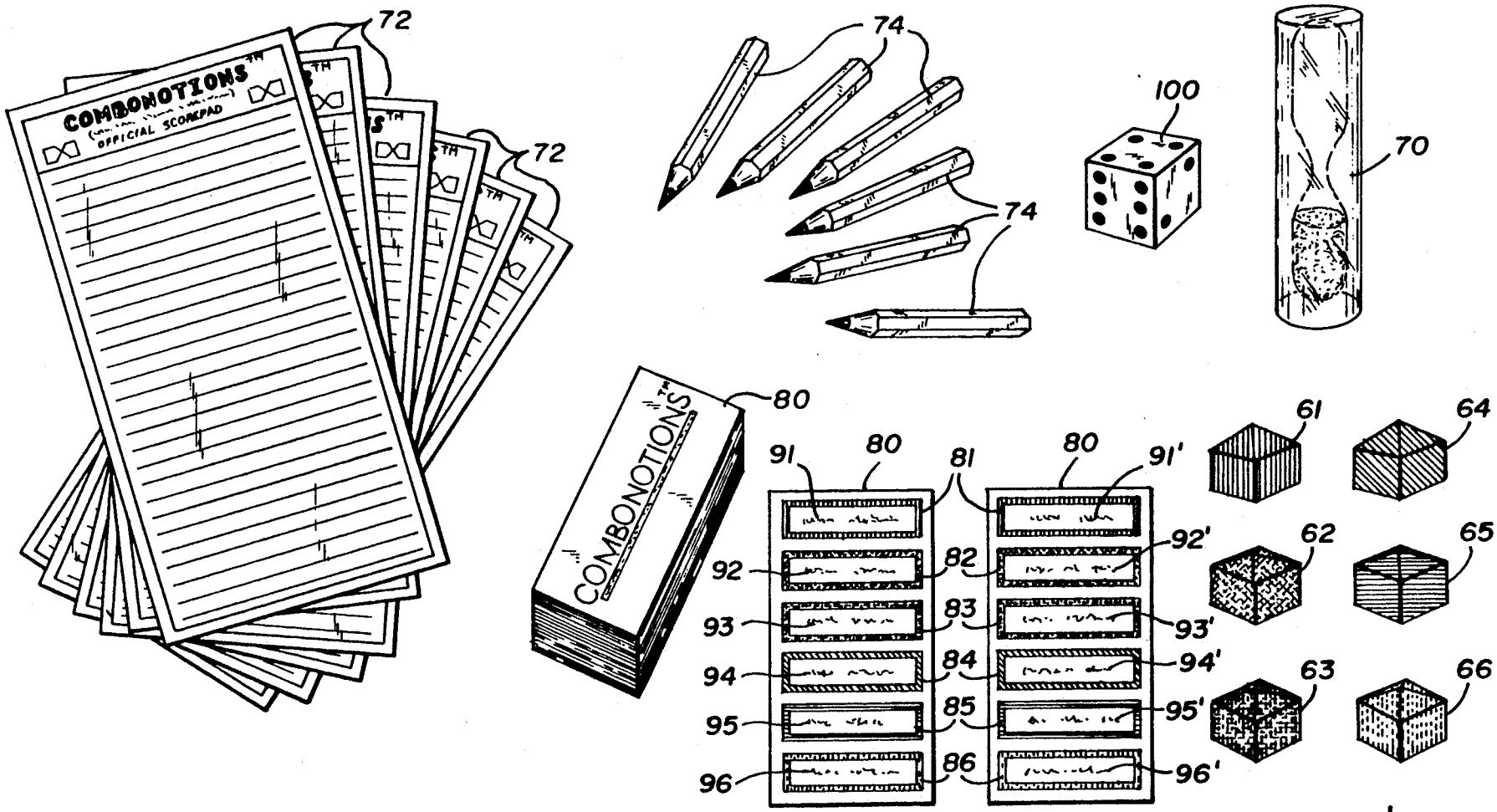
FIG. 2 is a perspective view of the equipment (namely, score pads, writing instruments, die, timer, pre-recorded word set cards [two of which are shown on a slightly enlarged scale for clarity], and player tokens), which together with the board of FIG. 1 is the presently preferred best mode of practicing the present invention.

As shown in FIG. 2, there is provided a timer 70 which preferably may be a simple "minute glass." In use, this timer is turned over at the start of a player's (or team's) turn and when the sand has run out so has the turn.

Each player or team is provided with means for recording a sequence of word sets and, as also shown in FIG. 2, this is preferably a score pad 72 and pencil 74.

The game includes a data base of word sets, each commonly-known phase or word set having a plurality of elements. This collection is preferably included in a set of cards 80 which is also shown in FIG. 2. These cards 80 have a back side (the blind side) which, like the back or ordinary playing cards, has the same design on each. (The two cards shown in FIG. 2 with their face side showing are depicted on a slightly enlarged scale for clarity. All such cards are preferably the same size.) The face side of the cards 80 are all laid out in the same arrangement, that is, with six colored border rectangles 81–86. These are colored red (81), orange (82), yellow (83), green (84), blue (85) and purple (86). Inside each rectangle is a different word set 91–96 (or 91'–96'). These word sets are different on each card in the set.

The word sets of the data base of cards 80 are in different groups or classifications or categories which are color-coded. These categories and their colors are PEOPLE—Red PLACES—Orange
TITLES—Blue
THINGS—Yellow
GENERAL—Green
SPORTS/GAMES—Purple For convenience of the players, the names of these categories with their associated colors as a background are placed on the board 10 (FIG. 1) at 99. These colors are, of course, the same as those used on the central areas of the spaces 11–53. That is, the centers of the spaces 11, 17, 25, 29, 34, 42, 44 and 52 are purple—the SPORTS/GAMES color. And the centers of the spaces 12, 20, 22, 28, 30, 38 and 46 are orange—or the PLACES color, while the center areas of spaces 13, 21, 23, 31, 39, 47 and 50 are yellow—the THINGS color 48 are green—the GENERAL category color coded. Completing the list, the center areas of spaces 15, 19, 27, 35, 37, 45 and 53 are red, for PEOPLE, and the remaining spaces 17, 25, 33, 41, 49 and 51, are, for TITLES, color-coded blue in their centers. Note that of the 43 spaces eight are purple and seven are of each of the other colors. This provides a more or less equal change for a token to land on each color and thus a more or less equal chance to select each category during the course of a game.

As mentioned above, the cards 80 have six color coded word sets each, one of each of the six categories. Examples of these are set out below in Table 1 for a number of different cards listed from categories.

TABLE 1

| PEOPLE | PLACES | THINGS | GENERAL | TITLES | SPORTS/ GAMES |
|---|---|---|---|---|---|
| David Letterman | Shepherd of the Hills Farms | Cover Letter | Sunny Side Up | Fantasy Island | Speed Rating |
| Eric The Red | Ripley, Tennessee | Drill Press | Shipshape | Great Pretender | Second Base |
| Julius Ceasar | Longwood Gardens | Juice Glass | Leave No Stone Unturned | Newsweek | Montreal Canadians |
| Robin Hood | Dead Sea | Scaletail | Coyote Ugly | The House of the Seven Gables | Down Rigger |
| Tony Bennett | Battle Creek, Michigan | Universal Joint | Against the Grain | Watership Down | Bank Shot |

Tables 2 through 6 are of more examples:

TABLE 2

| PEOPLE | PLACES | THINGS | GENERAL | TITLES | SPORTS/ GAMES |
|---|---|---|---|---|---|
| Bozo the Clown | Tom Mix Museum | Business Card | Throw in the Towel | Bridget Loves Bernie | The Meadowlands |
| Lou Christie | Joplin, Missouri | Magazine Rack | I Owe You One | Please Don't Eat The Daisies | Lawn Bowling |
| Bill Cosby | Ulysses, Kansas | Bookend | Two of a Kind | Behind Closed Doors | Time Trial |
| Hopalong Cassidy | Ohio River | Fruit Punch | Out of Order | Juke Box Hero | Pot Bunker |
| Charles Schultz | Strait of Gibraltar | Checkout Counter | The Honey-moon's Over | Come on Danger | Switch-Hitter |

TABLE 3

| PEOPLE | PLACES | THINGS | GENERAL | TITLES | SPORTS/ GAMES |
|---|---|---|---|---|---|
| Yogi Bear & Boo Boo | Pilgrim Glass | False Bot-tom | Quiet as a Mouse | I am Woman | Rodeo Clown |
| Forest Tucker | Prison Yard | Elephant's Ear | Rubbing Elbows | High Hopes | Sacrifice Fly |
| Blake Edwards | Truth or Consequences, New Mexico | Boxcar | Torn Down | Black Beauty | Three Rivers Stadium |
| Bruce Wayne | The Tomb of the Unknown Soldier | Camera Tripod | Thin-Skinned | Butterflies Are Free | The Florida Citrus Bowl |
| Ma Barker | Jamestown, Rhode Island | Masking Tape | Hope Springs Eternal | Prom Night | Kidney Punch |

code, and the centers of spaces 14, 16, 24, 31, 36, 40 and

TABLE 4

| PEOPLE | PLACES | THINGS | GENERAL | TITLES | SPORTS/ GAMES |
|---|---|---|---|---|---|
| Sitting Bull | Chesapeake Bay Maritime Museum | Space Heater | Bottom Out | The Sea Wolves | Clean and Jerk |
| Chicago Symphony Orchestra | Steamboat Springs, Colorado | Chimney Piece | The Golden Rule | Daddy's Little Girl | Super Stock |
| Hulk Hogan | North Cascades Highway | Fuzzy Dice | One More Time | King Kong | Pop-A-Shot |
| Girl Friday | Petrified Forest National Park | Fence Post | Purr Like a Kitten | I Heard It Through the Grapevine | Ringtoss |
| Charlie | Stouffers | Cheesepuff | The Home | Creature from | Sweatband |

TABLE 4-continued

| PEOPLE | PLACES | THINGS | GENERAL | TITLES | SPORTS/ GAMES |
|---|---|---|---|---|---|
| Brown | Hotels | | of the Brave | the Black Lagoon | |

TABLE 5

| PEOPLE | PLACES | THINGS | GENERAL | TITLES | SPORTS/ GAMES |
|---|---|---|---|---|---|
| Lauren Bacall | Lake Mead National Recreation Center | Lemonade Stand | Just The Facts, Ma'am | Over My Head | Los Angeles Kings |
| Harlem Globetrotters | Outback | Foam Rubber | Penny for Your Thoughts | Iron Eagle | Put and Take |
| Blood, Sweat & Tears | Trunk Bay | Boy Scout Jamboree | Top Dog | Black Sheep Squadron | Three of a Kind |
| Truman Capote | Baptism River State Park | Vanity Mirror | Act Your Age | Welcome Back, Kotter | Bait Caster |
| Dwight D. Eisenhower | Saints Auditorium | Diamondback Rattlesnake | Sock It To Me | Gentlemen Prefer Blondes | Shut the Box |

TABLE 6

| PEOPLE | PLACES | THINGS | GENERAL | TITLES | SPORTS/ GAMES |
|---|---|---|---|---|---|
| King Authur | Lincoln Park | Lace Panties | Kissin' Cousins | Old Yeller | Michigan Wolverines |
| Barry Goldwater | Virgin Mountains, Arizona | Bike Rental | Wait and See | Bachelor Party | Tree Stand |
| Groucho Marx | Page, North Dakota | Flight Attendant | Pins and Needles | In Harm's Way | Race Walking |
| The Pink Panther | Blue Licks Battlefield | Tie Clasp | As Easy as a Hot Knife Thru Butter | Trilogy of Terror | Blackjack |
| Perry Como | Fort Lauderdale, Florida | Port of Call | Education Makes the Man | The African Queen | Free Throw |

Also shown in FIG. 2 is a single die 100 which with the cards 80 and board 10 serves as means for randomly selecting one of the included word sets such as those listed above in Tables 1, 2, 3, 4, 5 and 6, as will be explained below.

RULES

A set of rules is also provided with the game, which rules may read as follows:

Rules for Basic Play

Equipment:

COMBONOTIONS contains one game board, one die, one minute timer, six player tokens, six score pads, six pencils and 798 word combo cards.

Object of the Game:

To be the first team (consisting of one or more players (to reach 100 points by creating various word combinations based on the previous word combination. (These combinations will be described later in detail.)

Preparation:

Place the timer die, and combo cards, so that all players have access to them. Divide the players into equal teams. Each team should be issued a token, a scorecard, and a pencil. Place a token for each team on the starting space located in the center of the board. Select a member from each team to roll the die to determine which team rolls first. The highest roller begins. Each team should select a person to write the combinations down. (Note: the scribe may change between team members for each round.)

Play:

Roll the die. Following either arrow, move the token the appropriate number of spaces. When the token lands on a colored square, a card is drawn from the card box. The color of the square's center determines the category of the initial word combo. The six categories are PEOPLE, PLACES, TITLES, THINGS, GENERAL, and SPORTS/GAMES. The scribe announces the initial word combo. He should be given sufficient time to write down the initial word combo in the space provided on the score pad before the opposing team starts the timer. Once the timer is started, the scribe and his teammates being creating new word combinations by using one or more words from the previous combo until the timer has run out. The word combos created must be well known people, places, things, titles, sports/games or phrases. The last word combo created becomes the starting point for the next word combo to be created. Please see example 1*a*, 1*b* and 1*c*. NOTE: The first word combo created does not necessarily have to be in the same category as the initial word combo.

Scoring

At the end of each round, the scribe totals up the points with one point awarded for each valid word combination (including the initial word combo written by the scribe. If time expires while a word combo is being written, the team receives full credit for that combo. Play continues until one team reaches at least 100 points.

Special Instruction (S.I.) Spaces:

When a team's token lands on a S.I. space, roll the die an extra time to determine which of the following special instructions apply.

| DIE ROLL | SPECIAL INSTRUCTION |
|---|---|
| 1 or 2 | SI 1. The word combo created must end with the first word from the previous combo. Please see example 2a. |
| 3 or 4 | SI 2. The word combo created must begin with the last word from the previous combo. |

-continued

| DIE ROLL | SPECIAL INSTRUCTION |
|---|---|
| | Please see example 2b. |
| 5 | SI 3. No special instructions apply. |
| 6 | SI 4. Team loses turn. |

Restrictions:

During a round, NO more than 3 combinations can use the same word. This is necessary to eliminate people from using lists. Please see example 3*a*.

The created word combination must be "well known." By "well known" we mean the word combination has to be an actual or real person, place, title, phrase or thing known to a majority of the players. For example, the word combo "CHICKEN ICE CREAM" would be invalid, because to the best of our knowledge, no such thing exists. From time to time, due to the nature of this game, questionable word combos will occur. The final determination of whether or not a word combo or phrase is valid must ultimately be made by the players.

When creating new combos, variations, portions, or homonyms of a previous word can be used as the starting point of the next word combo. If the starting combo was DOWN COAT, the word "DOWN" could be used to create a multitude of combinations. Examples of the would be "Down By the Old Mill Stream," "Downy Fabric Softener," "Down's Syndrome," "Churchill Downs," etc.

If the created word combo consists of only one word, that word must be able to be phonetically broken apart into at least two smaller words. For example, "LEADERSHIP" can be broken into LEADER and SHIP. Whereas "MISSION" cannot be phonetically broken into two meaningful words; thus, MISSION is an invalid word combo.

Articles of the English language (a, an, the) cannot be used as the basis for creating new word combos. For example, "The Godfather"]could not be created from "The Man from Uncle".

Challenging:

At the end of each round, opposing team may challenge the other team's word combos on the basis that the combo falls to meet the above restrictions. If the challenged combo is found invalid, the team only receives points for those combos created before the invalid combo. However, if the challenged word combo is valid, the points awarded are doubled for it and each succeeding combo.

Helpful Hints:

If during play a team generates a "dead end combo" (that is, a word combo from which no other combos can be derived), the dead end combo may be erased, making the previous combo the point from which to continue. Also, the scribe should not be overly concerned with spelling or punctuation when writing down combos. He should try to get as many combos written down as possible. Ditto marks (") may be used if desired to mark similar parts of combos.

Rules for Advanced Play

General:

Rules for the advanced game are similar to those of the basic game, with the following changes:

Play:

After a token lands on any space other than a Special Instruction space, draw a card form each card box. The first card drawn contains the starting word combo; its category is determined by the color of the square's center. The color of the square's border determines the category of the ending word combo from the second card. If the beginning and ending combos have a common word, the ending combo must be redrawn. Once the timer is starting, the scribe and his teammates must attempt to derive the ending word combo from the starting word combo. Please see examples 4*a*, 4*b* and 4*c*. The round continues until the ending combo has been derived or time has expired.

Scoring:

Five points are awarded for reaching the concluding combination. Additional Bonus Points are awarded as follows:

| # of combos used (not including starting or ending combos) | Bonus Points Awarded | Examples |
|---|---|---|
| 1 | 9 | |
| 2 | 8 | |
| 3 | 7 | 4a |
| 4 | 6 | |
| 5 | 5 | |
| 6 | 4 | 4b |
| 7 | 3 | |
| 8 | 2 | |
| 9 | 1 | |
| 10 or more | No bonus points | 4c |

Special Instructions (S.I.) Spaces:

When a team's token lands on a S.I. space, before drawing the combo cards, roll the die again. A die roll of 1-3; the rolling team determines categories of the stating and ending word combos. A die roll of 4-6; the opposing team to the left of the rolling team chooses the categories for the starting and ending combinations.

Challenging:

If an opposing team successfully challenges a word combo, no points are awarded to the rolling team. If an opposing team unsuccessfully challenges a word combo, the points awarded to the rolling team are doubled.

Helpful Hints:

If the players determine that the one minute time limit is too severe a restriction for the advanced game, the time limit may be extended in one minute intervals by flipping the timer over. All players must agree on the length of time permitted during the rounds.

Examples:

| 1a CLOWN FACE | 1b JOHN WAYNE | 1c CHICAGO CUBS |
|---|---|---|
| Face the Music | Wayne Newton | Cub Scout |
| Music Man | Fig Newton | Eagle Scout |
| Man from Uncle | Fig Tree | Jeep Eagle |
| Uncle Toms Cabin | Peach Tree | Jeepers Creepers |
| Cabin Fever | Peaches & Cream | where'd you get |
| Scarlet Fever | Creamed Corn | those peepers |
| Scarlet O'Hara | Corn on the Cob | Mr. Peepers |
| etc. | Ty Cobb | Mister Rogers |

-continued

| Examples: | | |
|---|---|---|
| | etc. | Roger Rabbit<br>Braer Rabbit<br>etc. |
| 2a TABLESPOON<br>End Table<br>Rear End<br>Step to the Rear<br>Texas Two Step<br>etc. | 2c PET ROCK<br>Rock Hudson<br>Hudson Bay<br>Bay Leaf<br>etc. | 3a KANSAS CITY,<br>Missouri<br>Kansas State<br>University<br>Indiana University<br>University of<br>Kansas<br>Kansas City<br>Chiefs-INVALID<br>Kansas City<br>Royals-INVALID |
| 4a FIELD GOAL<br>Soccer Goal<br>Soccer Ball<br>Gum Ball<br>Bubble Gum | 4b COFFEE MUG<br>Cup of Coffee<br>Tea Cup<br>Tea Bag<br>Paper Bag<br>Paper Boy<br>Delivery Boy<br>Delivery Room | 4c BOOK SHELF<br>School Books<br>School Bell<br>Bell Tower<br>Bell Pepper<br>Salt & Pepper<br>Salt Block<br>Wood Blocks<br>Wood Shop |

It should be clear from the above rules as to the manner of play. However, the purposes of illustrations, let us go through a series of moves in a typical match. For simplicity, let's have only two players (or teams). Although the game would go substantially in the same way, it is easier to describe a two-player match and just as illustrative. Let us assume Red is the first player and the second player is Yellow and that they respectively chose red token 61 and yellow token 63. The die 100 is cast by each and Red wins the right to start. Red places token 61 on space 11 and again throws the die 100 and gets a 6. At this point, he can choose to move his token sic spaces in either of two directions (as indicated by the arrows in spaces 12 and 33) and place it on space 17 (blue) or space 38 (orange). Since Red likes the category "Titles" (blue) better than "Places" he chooses to place his token on space 17. Red then (blindly without looking at the faces) draws the card 80 which, let's say, reads:

SONNY LISTON
CEDAR POINT, KANSAS
SPEEDSTICK
BLOW HOT AND COLD
THE SHAKIEST GUN IN THE WEST
CHIP SHOT

Since he has landed on a blue space, his starting word set is "The Shakiest Gun in the West" and Red writes this down on the top sheet of a pad 72 using a pencil 74. At the same time, Yellow turns over the timer 70. Red enters the following sequence before his turn runs out.

1. The Shakiest Gun in the West
2. West Virginia
3. Virginia Ham
4. Ham and Eggs
5. The Chicken or the Egg
6. Chicken Little
7. Little Richard
8. Richard Kinney
9. Kinney Shoes
10. Shoe Fly Shoe
11. Fly the Friendly Skies
12. Officer Friendly and thus Red gets 12 points.

(Yellow could "challenge" Red on his 8th entry on the grounds that Richard Kinney is not a commonly known word set, but believing patent lawyers are perhaps famous and Yellow being somewhat cowardly, decides not to risk a challenge.) Yellow places his yellow token at start (space 11) and throws a "1" with die 100. His choices are spaces 12 or 33 and he selects the orange space 12. Picking a card blindly, Yellow gets the following card FRANKLIN D. ROOSEVELT
POWDER RIVER, WYOMING
ENGLISH MUFFIN
ROCK-N-ROLL
HITCHHIKER'S GUIDE TO THE GALAXY
RUNNING BACK And Yellow enters the following on his pad 72 while the sands run out of the timer 70 which was reset by Red:

1. Powder River, Wyoming
2. Yellow River, China
3. John River
4. Peter River
5. Mary River However, Red being naturally aggressive challenges John River, Peter River and Mary River, citing the restrictions against non-well-known people and repeating the same elements. Yellow gets two points.

Next, Red throws the die 100 again and gets a "5" and thus lands on space 22 which is both orange color-coded and an special rule instruction (SI) space. Following the rules, Red throws the die again and gets a "2". This means that his entered word sets must all end with the first word element of the preceding set. He draws a new card from the pile of cards 80 and its orange-bordered word set reads

SEVEN SISTERS FALLS, MANITOBA

Red enters that and the following on his pad

MAGNIFICENT SEVEN
TRULY MAGNIFICENT
YOURS TRULY
SINCERELY YOURS
MOST SINCERELY to gain six more pints or a total of 18.

Yellow and Red continue taking turns in this manner until Red wins with 101 points to Yellow's 36.

It should now be apparent that a new and improved word association game has been described and depicted which can be used to develop verbal skills and provided entertainment. While th game has been described in is presently preferred form, many other forms can be employed, for example, it can be adapted to be a computer game or other timer and random selection means can be employed.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

APPENDIX - CURRENTLY PREFERRED DATA BASE WORD SETS

© J. D. Gazdick & J. J. Petrovich 1990, 1991

| | | | | | |
|---|---|---|---|---|---|
| BATMAN & | BEAVER | BEETLE | BEN | BENJAMIN | BERT & |
| ROBIN | CLEAVER | BAILEY | CRENSHAW | FRANKLIN | ERNIE |
| VIDEO | VEGA, | VAUGHN, | VATICAN | VALLEY | VALENTINE, |
| ARCADE | TEXAS | NEW MEXICO | CITY | FORGE | NEBRASKA |
| BIRD FEEDER | BIRTHSTONE | BISCUITS AND GRAVY | BLACK RUSSIAN | BLOODY MARY | BLOW-FISH |
| UP THE | UP THE CREEK | UNTIL THE COWS | UNLUCKY IN LOVE, | UNDER THE | UNDER MY |
| RIVER | WITHOUT A PADDLE | COME HOME | LUCKY IN CARDS | WIRE | THUMB |
| BANANA BOAT | BAND ON | BANG THE DRUM | BARNEY | BATTLE OF | BEAST OF |
| SONG | THE RUN | SLOWLY | MILLER | THE BULGE | BURDEN |
| TOUCHDOWN | TOUCH | TOTE | TOSSUP | TORONTO | TORONTO |
| | FOOTBALL | BOARD | | MAPLE LEAFS | BLUE JAYS |
| BETSY | BETTE | BIG AUDIO | | | |
| ROSS | DAVIS | DYNAMITE | | | |
| UNIVERSITY OF | UNITED NATIONS | UNION CITY, | | | |
| MONTANA | BUILDING | TENNESSEE | | | |
| BLUE | BLUEBERRY | BOAT | | | |
| JEANS | | LAUNCH | | | |
| UNDER LOCK | UGLY | TWO WRONGS DON'T | | | |
| AND KEY | DUCKLING | MAKE A RIGHT | | | |
| BEAUTY AND | BEDTIME FOR | BEER BARREL | | | |
| THE BEAST | BONZO | POLKA | | | |
| TOP WATER | TOP | TOE | | | |
| PLUG | TEN | HOLD | | | |
| KUKLA, FRAN AND | LADY BIRD | LADY | LADY | LADY | LARRY |
| OLLIE | JOHNSON | DIANA | GODIVA | MACBETH | BIRD |
| LEAVENWORTH | LAWRENCE, | LAVA BED | LAUREL, | LASALLE | LAKE SHORE |
| STATE PRISON | KANSAS | NATIONAL MONUMENT | DELAWARE | STREET | DRIVE |
| LAWBOOK | LAWN | LAZYBOY | LEAD | LEAF | LEAP |
| | JOCKEY | RECLINER | PIPE | LETTUCE | YEAR |
| KIDS SAY THE | KICK | KICK LIKE | KEEP YOUR SHOULDER | KEEP YOUR | KEEP YOUR |
| DARNDEST THINGS | THE BUCKET | A MULE | TO THE WHEEL | DISTANCE | CHIN UP |
| ONCE IN LOVE | ONCE UPON A TIME | ONE DAY | ONE LESS BELL | ONE LIFE | ONLY |
| WITH AMY | IN THE WEST | AT A TIME | TO ANSWER | TO LIVE | THE LONELY |
| MATCH | MARIO | MAN-IN | MAN | MAKE-UP | MAJOR |
| PLAY | BROTHERS | MOTION | OF WAR | GAME | INDEPENDENT |
| LARRY | LARRY | LAS VEGAS | | | |
| FINE | HAGMAN | SHOWGIRL | | | |
| LAKE POINT | LAKE PLACID, | LAKE | | | |
| TOWER | NEW YORK | MICHIGAN | | | |
| LEATHER | LEG | LEGAL GUARDIAN | | | |
| JACKET | GARTER | | | | |
| KEEP IT UNDER | KEEP IT TO | JUST WIN, | | | |
| YOUR HAT | YOURSELF | BABY | | | |
| OTHER | OUR | OUT OF | | | |
| WOMAN | MISS BROOKS | AFRICA | | | |
| MADISON SQUARE | LOSING | LOS ANGELES | | | |
| GARDEN | STREAK | LAKERS | | | |
| WILLIAM | ZEPPO | WILLIAM | WILLIE | WILSON | WILT |
| POWELL | MARX | TELL | SHOEMAKER | PICKETT | CHAMBERLAIN |
| AMERIA'S | AMAZON | ALADDIN HOTEL & | ALABAMA SPACE & | AGRICULTURE | ADLER |
| DAIRYLAND | RIVER | CASINO | ROCKET CENTER | HALL OF FAME | PLANETARIUM |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| WOOL | WORD | WORLD'S | WRAPPING | WRISTBAND | YARD |
| MITTEN | PROCESSOR | FAIR | PAPER | | STICK |
| A FLYING | A FATE WORSE | A DIAMOND | A CHIP OFF | A BONE | A BIRD IN THE HAND IS |
| START | THAN DEATH | IN THE ROUGH | THE OLD BLOCK | TO PICK | WORTH TWO IN |
| | | | | | THE BUSH |
| YOU ARE MY | YOU BET | YOU OUGHTA | YOU'RE | YOU'VE GOT | YOUNG |
| LUCKY STAR | YOUR LIFE | BE IN PICTURES | SO VAIN | A FRIEND | FRANKENSTEIN |
| ALL TERRAIN | ALABAMA | AIR | AIR | AEROBIC | ADDRESS |
| VEHICLE | CRIMSON TIDE | JORDON | HOCKEY | WORKOUT | THE BALL |
| WINDOW | KATE | KATHARINE | | | |
| WASHER | SMITH | HEPBURN | | | |
| ADAMS, | LOGGING | LOGAN, | | | |
| MASSACHUSETTS | CAMP | NEW MEXICO | | | |
| ZOOM | KICKSTAND | KING | | | |
| LENS | | PENGUIN | | | |
| A BABE IN | LADY | LABOR OF | | | |
| THE WOODS | LUCK | LOVE | | | |
| YOUR CHEATING | NORTH DALLAS | NORTH | | | |
| HEART | FORTY | TO ALASKA | | | |
| ACROSS | MISSILE | MINOR | | | |
| THE BOARD | COMMAND | LEAGUES | | | |
| ARISTOTLE | ARMED | ARNOLD | ART | ARTHUR | ARTIS |
| ONASSIS | GUARD | PALMER | CARNEY | MURRAY | GILMORE |
| WEATHER | WAX | WATSONVILLE, | WATERPROOF, | WATCHTOWER | WASHINGTON, |
| STATION | MUSEUM | CALIFORNIA | LOUISIANA | | DISTRICT OF COLUMBIA |
| BAKED | BAMBOO | BAND | BANKROLL | BAR | BARBED |
| BEANS | SHOOT | SAW | | STOOL | WIRE |
| WHATEVER WILL | WHAT GOES AROUND | WET YOUR | WE'RE ON A ROAD | WELL-DONE | WELL, |
| BE WILL BE | COMES AROUND | WHISTLE | TO NOWHERE | | FANCY THAT |
| AMERICAN | AN AMERICAN WERE- | AN OFFICER AND | ANATOMY OF A | AND GOD | AND I |
| WOMAN | WOLF IN LONDON | A GENTLEMAN | MURDER | CREATED WOMAN | LOVE HER |
| UP THE | UNSPORTSMANLIKE | UNPLAYABLE | UNITED STATES | UNDERWATER | UNDERHAND |
| MIDDLE | CONDUCT | LIE | GOLF ASSOCIATION | PLUG | |
| AUDRY | AVON | B. B. | | | |
| HEPBURN | LADY | KING | | | |
| WARWICK, | WAREHOUSE | WAR, | | | |
| RHODE ISLAND | | WEST VIRGINIA | | | |
| BARBER | BARBIE | BASS | | | |
| POLE | DOLL | ALE | | | |
| WELL I'LL | WELCOME WITH | WEAR AND | | | |
| BE | OPEN ARMS | TEAR | | | |
| ANGEL ON | ANIMAL | ANNIE GET | | | |
| MY SHOULDER | FARM | YOUR GUN | | | |
| TWO-MINUTE | TWO STROKE | TWENTY-ONE | | | |
| WARNING | PENALTY | | | | |
| THE INCREDIBLE | THE JACKSON | THE KEYSTONE | THE LENNON | THE LONE | THE MARX |
| HULK | FIVE | COPS | SISTERS | RANGER | BROTHERS |
| BOURBON | BOSTON, | BOOTH BAY | BOOT HILL, | BOONE, | BONESTEEL, |
| STREET | MASSACHUSETTS | HARBOR | KANSAS | IOWA | SOUTH DAKOTA |
| TEST TUBE | THE MONA | THERMAL | THOMPSON | THREE-RING | THROW |
| | LISA | UNDERWEAR | SEEDLESS GRAPES | CIRCUS | RUG |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| AT DEATH'S | AT BREAKNECK | AT A FEVER | ASHES TO ASHES, | AS SLY AS | AS RED |
| DOOR | SPEED | PITCH | DUST TO DUST | A FOX | AS BLOOD |
| TIGHTROPE | TO BUILD A | TO CATCH | TO KILL | TOM | TOO HOT |
| | FIRE | A THIEF | A MOCKINGBIRD | AND JERRY | TO HANDLE |
| BOSTON | BOLT | BODY | BODY | BOBSLED | BOBBING FOR |
| CELTICS | ACTION | CHECK | BUILDING | | APPLES |
| THE NEW YORK | THE OSMOND | THE PET SHOP | | | |
| PHILHARMONIC | BROTHERS | BOYS | | | |
| BOMB | BOGUS BASIN | BOARDWALK | | | |
| SHELTER | SKI AREA | | | | |
| THUMBTACK | TICKER TAPE | TICKET | | | |
| | PARADE | STUB | | | |
| AS MAS AS | AS GOOD | AS EASY | | | |
| A HORNET | AS GOLD | AS PIE | | | |
| TOO LATE TO | TOUCH OF | TRAIN KEPT | | | |
| TURN BACK NOW | EVIL | A ROLLIN' | | | |
| BLUE | BLIND MAN'S | BLEACHER | | | |
| CATFISH | BLUFF | BUM | | | |
| FAY | FAYE | FELIX THE | FIBBER | FIDEL | FIREMAN |
| WRAY | DUNAWAY | CAT | McGEE | CASTRO | |
| RED WING, | RED LION, | RED LIGHT | RECOVERY | RAPID RIVER | RANGER |
| MINNESOTA | PENNSYLVANIA | DISTRICT | ROOM | LOGGING CAMP | PEAK |
| DUNEBUGGY | DUST | DUTCH | EARTHENWARE | EASTER | EELSKIN |
| | BUSTER | OVEN | | CARD | LEATHER |
| SEA | SCREW | SCARED TO | SCARED | SCARED OF | SAY YOUR |
| LEGS | LOOSE | DEATH | STIFF | YOUR OWN SHADOW | PRAYERS |
| HARPER VALLEY | HAVE GUN | HAWAII | HEART OF | HEARTBREAK | HEAVEN CAN |
| P.T.A. | WILL TRAVEL | FIVE-O | GOLD | RIDGE | WAIT |
| SCAVENGER | SAND | SAN FRANCISCO | SAN FRANCISCO | SAN DIEGO | SAN DIEGO |
| HUNT | TRAP | GIANTS | 49'RS | PADRES | CHARGERS |
| FIRST | FLIP | FLORENCE | | | |
| MATE | WILSON | NIGHTINGALE | | | |
| RANDOLPH, | RAIN | RAIL | | | |
| VERMONT | FOREST | YARD | | | |
| EGG FOO | ELBOWROOM | ELECTRIC | | | |
| YOUNG | | RAZOR | | | |
| SAY IT WITH | SAVED BY | SAVE YOUR | | | |
| FLOWERS | THE BELL | BACON | | | |
| HELLO, | HERE COME THE | HERE COMES | | | |
| DOLLY! | BRIDES | THE SUN | | | |
| SAN ANTONIO | SAM | SAILBOAT | | | |
| SPURS | SNEAD | | | | |
| CHRISTIE | CHRISTOPHER | CHRISTOPHER | CHUCK | CLARK | CLARK |
| BRINKLEY | COLUMBUS | ROBIN | BERRY | GABLE | KENT |
| ST. PETERSBURG, | ST. PATRICK'S | ST. LOUIS, | ST. AUGUSTINE, | ST. LAWRENCE | SQUAW |
| FLORIDA | CATHEDRAL | MISSOURI | FLORIDA | SEAWAY | MOUNTAIN |
| CIGARETTE | CITIZEN'S | CITRUS | CITY | CLAMBAKE | CLASS |
| FILTER | BAND RATIO | FRUIT | CHICKEN | | RING |
| THE FAT OF | THE ENEMY IS | THE END OF | THE END | THE EARLY BIRD | THE CREAM RISES |
| THE LAND | AT HAND | THE RAINBOW | JUSTIFIES THE MEANS | GETS THE WORM | TO THE TOP |
| DEAD | DEATH ON THE | DEEP IN THE HEART | DENNIS THE | DESIGNING | DESTRY |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| RINGERS | NILE | OF TEXAS | MENACE | WOMEN | RIDES AGAIN |
| STUD | STROKE-AND- | STROKE | STRIKEOUT | STRIKE | STRAIGHT-ARM |
| POKER | DISTANCE | PLAY | | THREE | |
| CLAUDE | CLEVON | CLINT | | | |
| PEPPER | LITTLE | EASTWOOD | | | |
| SPRINGFIELD, | SPORTMART | SPENCER, | | | |
| ILLINOIS | | NEW YORK | | | |
| CLAW | CLEAN AIR | CLING | | | |
| HAMMER | ACT | PEACHES | | | |
| THE COAST | THE CHECK IS | THE CAUTIOUS | | | |
| IS CLEAR | IN THE MAIL | SELDOM ERR | | | |
| DIAL M | DIAMONDS ARE | DIFF'RENT | | | |
| FOR MURDER | FOREVER | STROKES | | | |
| STRAIGHT | STOLEN | STOCK | | | |
| FLUSH | BASE | CAR | | | |
| THOMAS | THOMAS | THREE DOG | TIM | TIMOTHY | TIP |
| EDISON | JEFFERSON | NIGHT | CONWAY | LEARY | O'NEIL |
| BERKELEY OPEN | BERING | BELT, | BEAVER | BEAR TOOTH | BEACON FALLS, |
| PIT MINE | STRAIT | MONTANA | ISLAND | SCENIC HIGHWAY | CONNECTICUT |
| TRACK | TRAFFIC | TRAILER | TREASURE | TURN | TV TRAY |
| LIGHTING | COURT | HITCH | CHEST | SIGNAL | |
| AN ANGEL ON | ALL'S WELL | ALL'S FAIR | ALL MEN ARE | ALL IN A | ALL FIRED |
| MY SHOULDER | THAT ENDS WELL | IN LOVE AND WAR | CREATED EQUAL | DAYS WORK | UP |
| VALLEY OF | VISION | VIVA | VOYAGE TO THE | WAGONMASTER | WAIT UNTIL |
| THE DOLLS | QUEST | LAS VEGAS | BOTTOM OF THE SEA | | DARK |
| BEAR | BATTLESHIP | BATTING | BATTER | BAT | BASKETBALL |
| ARCHERY | | AVERAGE | UP | AROUND | COURT |
| TOM | TOM | TOM | | | |
| CRUISE | JONES | KITE | | | |
| BEACHES OF | BEACH | BAY | | | |
| NORMANDY | FRONT | BRIDGE | | | |
| U.S. | ULTRAVIOLET | UNDERTOW | | | |
| STEEL | RAY | | | | |
| ALIVE AND | AIRSICK | AIR-BORNE | | | |
| KICKING | | | | | |
| WALK LIKE | WALK ON | WAR AND | | | |
| AN EGYPTIAN | THE WILD SIDE | PEACE | | | |
| BASES | BASE ON | BARREL OF | | | |
| LOADED | BALLS | MONKEYS | | | |
| ORSON | OSCAR THE | P. T. | PARKER | PAT | PAT |
| WELLES | GROUCH | BARNUM | BROTHERS | BOONE | GARRETT |
| GANGES | GAMBLE, | GAIL, | FUN | FROSTBITE | FRIENDSHIP, |
| RIVER | OHIO | TEXAS | HOUSE | FALLS | OHIO |
| PIXIE | PIZZA HUT | PLACE | PLANE | PLASTIC | PLAYBOY |
| STICKS | RESTAURANT | MAT | CRASH | SHOP | |
| FINDERS KEEPERS, | FIND | FIGHT TO | FIGHT FIRE | FEET OF | FEEL IT IN |
| LOSERS WEEPERS | FAULT | THE FINISH | WITH FIRE | CLAY | MY BONES |
| SWEET BIRD | SWEET LITTLE | SWINGING ON | SWISS FAMILY | TAKE ME OUT | TALK |
| OF YOUTH | SIXTEEN | A STAR | ROBINSON | TO THE BALLGAME | RADIO |
| GO BIG | GLASS | GIVE AND | GIN | GEORGIA TECH | GENERAL |
| RED | JAW | GO | RUMMY | YELLOW JACKETS | MANAGER |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| PATTI | PATTY | PATTY | | | |
| PAGE | DUKE | HEARST | | | |
| FRIDAY HARBOR, | FRESNO, | FRENCH | | | |
| WASHINGTON | CALIFORNIA | RIVIERA | | | |
| PLUMBER'S | POCKETWATCH | POGO | | | |
| HELPER | | STICK | | | |
| FEED A COLD | FATHER'S | FAT | | | |
| AND STARVE A FEVER | DAY | CAT | | | |
| TAXI | TEA FOR | TEENAGER | | | |
| DRIVER | TWO | IN LOVE | | | |
| GARDEN | GAME | GAME | | | |
| PATH | BIRD | BALL | | | |
| TED | TELEPHONE | TENNESSEE | TERRY | TEX | THE ARTFUL |
| TURNER | REPAIR MAN | WILLIAMS | BRADSHAW | RITTER | DODGER |
| BUSCH GARDENS, | BUS | BURNS, | BUNKER | BULLHEAD CITY, | BUFFALO BILL |
| FLORIDA | STATION | OREGON | HILL | ARIZONA | STATE HISTORIC PARK |
| SUNROOF | SURFBOARD | SWAMPLAND | SWEAT | SWEDISH | SWING |
| | | | PANTS | MEATBALL | SET |
| BEAT | BEAR | BE ALL THAT | BE A | BATTLE | BATTON DOWN |
| IT | DOWN | THAT YOU CAN BE | MAN | ROYAL | THE HATCHES |
| THE WILD | THE WIND IN | THE WITCHES | THE WOMAN | THE WORLD | THE WRONG |
| BUNCH | THE WILLOWS | OF EASTWICK | IN RED | ACCORDING TO GARP | MAN |
| CALLING THE | CALIFORNIA | CALGARY | BUFFERFLY | BUSCH MEMORIAL | BULLS-EYE |
| SHOT | ANGELS | FLAMES | STROKE | STADIUM | |
| THE BEACH | THE BIG | THE BIRDMAN | | | |
| BOYS | BAD WOLF | OF ALCATRAZ | | | |
| BUCKLAND, | BUCKINGHAM | BRYCE CANYON | | | |
| ALASKA | FOUNTAIN | NATIONAL PARK | | | |
| SWISS | SWITCH | SWORDFISH | | | |
| CHALET | HOOK | | | | |
| BATS IN THE | BARKING UP THE | BAPTISM OF | | | |
| BELFRY | WRONG TREE | FIRE | | | |
| THERE SHE | THERE! I'VE | THERE'S NO BUSINESS | | | |
| GOES | SAID IT AGAIN | LIKE SHOW BUSINESS | | | |
| BULL | BUFFALO | BUFFALO | | | |
| FIGHTER | SABRES | BILLS | | | |
| ALAN | ALBERT | ALEX | ALEXANDER | ALEXANDER | ALFRED E. |
| KING | EINSTEIN | HALEY | GRAHAM BELL | THE GREAT | NEWMAN |
| WINTER HAVEN, | WINDSOR LOCKS, | WINDOW ROCK, | WIND CAVE | WINCHESTER, | WILSON, |
| FLORIDA | CONNECTICUT | ARIZONA | NATIONAL PARK | ILLINOIS | NORTH CAROLINA |
| ALARM | ALLOVER | ALUMINUM | AMPLIFIER AND | ANKLE | ANNIVERSARY |
| CLOCK | TAN | CAN | TUNER | HOLSTER | CARD |
| YOU CAN'T TEACH | YOU CAN'T TAKE | YOU CAN'T KEEP | YOU BET YOUR | YOU ARE | X MARKS |
| AN OLD DOG NEW | IT WITH YOU | A GOOD MAN DOWN | BOTTOM DOLLAR | WHAT YOU EAT | THE SPOT |
| TRICKS | | | | | |
| A MAN | A PLACE IN | A POOR LITTLE | A SHOT IN | A STREETCAR | A STRING |
| CALLED HORSE | THE SUN | RICH GIRL | THE DARK | NAMED DESIRE | OF PEARLS |
| WIDE | WHITEWASH | WHITE WATER | WHEELBARROW | WET | WESTERN |
| RECEIVER | | RAFTING | RACE | SUIT | SADDLE |
| ALFRED | ALI | ALLIE | | | |
| HITCHCOCK | McGRAW | SHERMAN | | | |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| WILL | WILDLIFE | WILDCAT MOUNTAIN | | | |
| COUNTY | PRESERVE | TRAMWAY | | | |
| ANSWERING | APPLEJACKS | ARABIC | | | |
| MACHINE | | NUMERALS | | | |
| WRAPPED AROUND | WORTH HIS WEIGHT | WOLF IN | | | |
| YOUR LITTLE | IN GOLD | SHEEP'S CLOTHING | | | |
| FINGER | | | | | |
| A TALE OF | A TREE GROWS | A VIEW | | | |
| TWO CITIES | IN BROOKLYN | TO A KILL | | | |
| WELTERWEIGHT | WEIGHT | WEAK | | | |
| | LIFTING | SIDE | | | |
| VALERIE | VANESSA | VANNA | VICTORIA | VINCE | VINCENT |
| HARPER | WILLIAMS | WHITE | PRINCIPAL | LOMBARDI | PRICE |
| BADLANDS | BADGER | BAD AXE, | BACKSTAGE | B & O RAILROAD | AUTO BODY |
| NATIONAL PARK | MINE | MICHIGAN | | MUSEUM | SHOP |
| WAFFLE | WALKIE- | WALLFLOWER | WATER | WAX | WEATHER |
| IRON | TALKIE | | FOUNTAIN | LIPS | VANE |
| ABOUT-FACE | A WINNER NEVER | A WELL OILED | A WATCHED POT | A TOUGH NUT | A ROLLING STONE |
| | QUITS AND A QUIT- | MACHINE | NEVER BOILS | TO CRACK | GATHERS NO MOSS |
| TER NEVER WINS | | | | | |
| WHERE | WHERE'D YOU GET | WHISTLE WHILE | WHITE | WHITE HUNTER, | WHO'S AFRAID OF |
| EAGELS DARE | THOSE EYES | YOU WORK | CHRISTMAS | BLACK HARVEST | VIRGINIA WOOLF |
| ATLANTIC COAST | ATLANTA | ATHLETE'S | AT THE | ASSAULT ON | ARTIFICIAL |
| CONFERENCE | FALCONS | FOOT | WIRE | EVEREST | TURF |
| VIRGIL | W. C. | WALT | | | |
| WARD | FIELDS | DISNEY | | | |
| ATLANTIC CITY, | ATLANTA, | ASH FORK, | | | |
| NEW JERSEY | GEORGIA | ARIZONA | | | |
| WEDDING | WELCOME | WHEELBARROW | | | |
| BAND | MAT | | | | |
| A PIG | A PIECE OF | A PIECE OF CAKE | | | |
| IN A POKE | THE PIE | | | | |
| WHO'S | WHOLE LOT OF | WHY DO FOOLS | | | |
| NEXT | SHAKIN' GOING ON | FALL IN LOVE | | | |
| ARROWHEAD | ARROW SHAFT | AROUND | | | |
| STADIUM | | THE HORN | | | |
| SHIP | SHIRLEY | SHIRLEY | SHIRLEY | SHOE | SID |
| CAPTAIN | BOOTH | MACLAINE | TEMPLE | SALESPERSON | CAESAR |
| CLEMSON, | CLEARWATER, | CLAYTON, | CINCINNATI, | TOKYO, | CHOCOLATE |
| SOUTH CAROLINA | FLORIDA | NEW YORK | OHIO | JAPAN | MOUNTAINS |
| SOCIAL SECURITY | SOFA | SOFT | SOLAR | SONIC | SONY |
| NUMBER | SLEEPER | SOAP | SYSTEM | BOOM | WALKMAN |
| BROKEN | BRING DOWN | BREAK THE | BREADBASKET | BREAD AND | BRAINWASH |
| MAN | THE HOUSE | ICE | | WATER | |
| THE POSTMAN | THE PRIDE OF | THE PUBLIC | THE RAT | THE REAL | THE RETURN |
| ALWAYS RINGS TWICE | THE YANKEES | ENEMY | PATROL | McCOYS | OF THE KING |
| COMMUNITY | COMBONOTIONS | COIN ON | CO-ED | CLUBHOUSE | CLIFF |
| CHEST | | THE PLATE | GYM | | DIVER |
| SIGMUND | SIMON & | SIR FRANCIS | | | |
| FREUD | GARFUNKEL | DRAKE | | | |
| CHINA LAKE, | CHIMNEY ROCK | CHIEF BLACK | | | |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| CALIFORNIA | NATIONAL HISTORIC SITE | OTTER TRAIL | | | |
| SOUND | SOUP OF | SOUR | | | |
| EFFECTS | THE DAY | CHERRY | | | |
| BRAINSTORM | BOWED BUT NOT BROKEN | BOUND AND GAGGED | | | |
| THE | THE ROAD TO | THE ROAD | | | |
| RIFLEMAN | SINGAPORE | WARRIOR | | | |
| CLEVELAND | CLEVELAND | CLEMSON | | | |
| INDIANS | BROWNS | TIGERS | | | |
| GALE | GARFIELD | GARRETT | GARRY | GARY | GEENA |
| SAYERS | GOOSE | MORRIS | SHANDLING | COOPER | DAVIS |
| POMPEYS | POLE | POISON, | POINT STREET | PLYMOUTH | PLUMMER, |
| PILLAR | BARN | MONTANA | PARK | ROCK | IDAHO |
| EVERGREEN | EXERCISE BIKE | EXHAUST FAN | EXPENSE ACCOUNT | EXPRESSWAY | EYEBROW |
| REMEMBER THE | REEL HIM | READING, WRITING | READ HIM | RAN LIKE | RAKED OVER |
| ALAMO | IN | AND ARITHMETIC | THE RIOT ACT | A THIEF | THE COALS |
| HORTON HEARS | HOTEL | HOUND | HOUR OF | HOUSE OF THE | HOW THE GRINCH |
| A WHO | CALIFORNIA | DOG | THE WOLF | RISING SUN | STOLE CHRISTMAS |
| ROUNDHOUSE | ROUND THE CLOCK | ROUND ROBIN | ROULETTE WHEEL | ROUGHING THE KICKER | ROSIN BAG |
| GENE | GENERAL | GENERAL DOUGLAS | | | |
| HACKMAN | CUSTER | McARTHUR | | | |
| PLAZA | PIPESTONE | PIPERS | | | |
| HOTEL | NATIONAL MONUMENT | OPERA HOUSE | | | |
| FACE | FAIRY | FAITH | | | |
| CARD | TALE | HEALER | | | |
| RAISE THE | RAINING CATS | RACE THE | | | |
| ROOF | AND DOGS | WIND | | | |
| HOW THE WEST | HUSH . . . HUSH, | I AIN'T GOT | | | |
| WAS WON | SWEET CHARLOTTE | NOBODY | | | |
| ROPE | ROOKIE OF | ROLLER | | | |
| JUMPING | THE YEAR | DERBY | | | |
| MR. | MRS. | MUDDY | MUHAMMAD | MURPHY | NATALIE |
| SPOCK | O'LEARY | WATERS | ALI | BROWN | WOOD |
| GRAHAM, | GRACELAND | GOOSE ROCKS | GOODWATER, | GOODRICH, | GOLDEN NUGGET |
| TEXAS | | BEACH | ALABAMA | NORTH DAKOTA | HOTEL & CASINO |
| PEAR | PEER | PEG | PENCIL | PEPPERMINT | PERCUSSION |
| TREE | PRESSURE | LEG | LEAD | ICE-CREAM | SECTION |
| FOUGHT TOOTH | FORGIVE AND | FOREVER | FOREVER | FOOTLOOSE AND | FOOD FOR |
| AND NAIL | FORGET | YOUNG | AND A DAY | FANCY FREE | THOUGHT |
| ST. ELSEWHERE | ST. VALENTINE'S DAY MASSACRE | STAGECOACH | STAIRWAY TO HEAVEN | STAKEOUT | STAND AND DELIVER |
| HALL OF | HALF | HALF MILE | HALF | GUTTERBALL | GUN |
| FAME | TIME | TRACK | HITCH | | DOG |
| NATHAN | NEIL | NELSON | | | |
| HALE | ARMSTRONG | EDDY | | | |
| GOLDEN GATE | GOLD BEACH, | GLEN ELLIS | | | |
| BRIDGE | OREGON | FALLS | | | |
| PERFUME | PET | PHOTO | | | |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| BOTTLE | ROCK | ALBUM | | | |
| FLY-BY-NIGHT | FLY OFF THE | FLEW THE | | | |
| | HANDLE | COOP | | | |
| STAND BY | STAR 80 | STAR | | | |
| ME | | TREK | | | |
| GUESS THE | GROUND UNDER | GROUND | | | |
| NUMBER | REPAIR | RULES | | | |
| SPIRO | SPORTS | ST. FRANCIS | ST. | STAN LAUREL & | STEPHEN |
| AGNEW | WRITER | OF ASSISI | NICHOLAS | OLIVER HARDY | KING |
| CARTER CAVE | CARSON PIRIE | CARSON CITY, | CARROT RIVER, | CARROLL, | CARPENTER'S |
| STATE PARK | SCOTT & CO. | NEVADA | SASKATCHEWAN | IOWA | HALL |
| SPOTLIGHT | SPRING | SQUIRT | ST. CHRISTOPHER | ST. PATRICK'S | STAMP |
| | BREAK | GUN | MEDAL | DAY | COLLECTION |
| BLACK | BLACK AS | BITE THE HAND | BITE THE | BIRDS OF A FEATHER | BIRD'S-EYE |
| SHEEP | COAL | THAT FEEDS | BULLET | FLOCK TOGETHER | VIEW |
| THE SPY | THE STAR-SPANGLED | THE STREETS OF | THE SUN | THE SUNSHINE | THE TELLTALE |
| WHO LOVED ME | BANNER | SAN FRANCISCO | ALSO RISES | BOYS | HEART |
| CHICAGO | CHEST | CHEST | CHESSBOARD | CHEERLEADERS | CHECKMATE |
| BEARS | WADERS | PROTECTOR | | | |
| STEVE | STEVE | STEVIE | | | |
| ALLEN | LAWRENCE | WONDER | | | |
| CARNAGIE | CARLSBAD CAVERNS | CARLIN, | | | |
| HALL | NATIONAL PARK | NEVADA | | | |
| STAR OF | STATE | STEAK | | | |
| DAVID | CAPITOL | KNIFE | | | |
| BIGGER THAN | BIGGER FISH | BIG AS | | | |
| A BREAD BOX | TO FRY | ALL OUTDOORS | | | |
| THE TEN | THE TEXAS | THE THIEF | | | |
| COMMANDMENTS | CHAINSAW MASSACRE | OF BAGDAD | | | |
| CHECKERED | CHECKERBOARD | CHARLOTTE | | | |
| FLAG | | HORNETS | | | |
| RUDOLPH | RUTH | RYAN | RYNE | SALLY | SAM |
| VALENTINO | BUZZI | O'NEAL | SANDBERG | RIDE | SHEPARD |
| COULY DAM NATIONAL | COTTONDALE, | COSTER | CORNING | CORN | COPLY |
| RECREATION AREA | ALABAMA | STATE PARK | GLASS CENTER | PALACE | SQUARE |
| SHOESTRING | SHOOTING | SHOPPING | SHORE | SHORT | SHOULDER |
| POTATOES | STAR | CENTER | PATROL | STORY | BLADE |
| CATNIP | CATCHING TWENTY | CATCH A | CAST-IRON | CARSICK | CAN'T HAVE YOUR CAKE |
| | WINKS | RISING STAR | STOMACH | | AND EAT IT TOO |
| THE MAN IN | THE MANCHURIAN | THE MICKEY | THE MIRACLE | THE MISSILES OF | THE MONEY |
| THE IRON MASK | CANDIDATE | MOUSE CLUB | WORKER | OCTOBER | PIT |
| DARTBOARD | DALLAS | DAILY | D. P. FIT | CY YOUNG | CURLING |
| | COWBOYS | DOUBLE | FOR LIFE | AWARD | STONE |
| SAMMY | SAMUEL | SAMUEL | | | |
| DAVIS JR. | ADAMS | CLEMENTS | | | |
| COOPER LOG CABIN | COOK | CONWAY, | | | |
| MUSEUM | COUNTY | ARKANSAS | | | |
| SHOWDOWN | SHOWER | SHUT-EYE | | | |
| | MASSAGE | | | | |
| CAN'T BEAT | CALL OVER | CABIN | | | |
| THE FEELING | THE COALS | FEVER | | | |

-continued

APPENDIX - CURRENTLY PREFERRED DATA BASE WORD SETS

© J. D. Gazdick & J. J. Petrovich 1990, 1991

| | | | | | |
|---|---|---|---|---|---|
| THE MUMMY'S | THE MUSIC | THE NAKED | | | |
| HAND | MAN | GUN | | | |
| CUE | CROWN | CROSSWORD | | | |
| BALL | AND ANCHOR | PUZZLE | | | |
| EDDIE | EDGAR ALLEN | EDGER | EDWARD G. | EDWARD R. | ELIZABETH |
| VAN HALEN | POE | BERGEN | ROBINSON | MURROW | TAYLOR |
| ROSEBOWL | ROOSEVELT, | ROOFTOP | RODEO | ROCKY | ROCKY FORD, |
| RACEWAY | UTAH | | DRIVE | MOUNTAINS | COLORADO |
| DISPOSABLE | DITCH-WITCH | DOG | DOLLAR | DOORJAMB | DOUBLE |
| DIAPERS | | COLLAR | BILL | | DATE |
| SKATING ON | SIX FEET | SING LIKE | SILVER-TOUNGED | SILLY | SILENCE IS |
| THIN ICE | UNDER | A BIRD | DEVIL | GOOSE | GOLDEN |
| GIVE A | GO AWAY | GOATS HEAD | GOD BLESS | GOING IN | GOLDFINGER |
| LITTLE BIT | LITTLE GIRL | SOUP | AMERICA | STYLE | |
| SHOOTING | SHOOT THE | SHOCK | SHINGUARDS | SHADOW | SHAD |
| GLOVE | TUBE | WAVE | | BOWLING | RAP |
| ELKE | ELLIOT | ELMER | | | |
| SOMMER | GOULD | FUDD | | | |
| ROCKEFELLER | ROCK OF | ROCK BRIDGE | | | |
| CENTER | GIBRALTAR | CANYON, ALABAMA | | | |
| DOWNPOUR | DRAGONFLY | DRAINPIPE | | | |
| SICK AS A | SICK AND | SHUT YOUR | | | |
| DOG | TIRED | MOUTH | | | |
| GOLDILOCKS AND THE | GOOD MORNING, | GOODBYE | | | |
| THREE BEARS | VIETNAM | MR. CHIPS | | | |
| SEVENTH INNING | SEVEN TEN | SETTING THE | | | |
| STRETCH | SPLIT | HOOK | | | |
| ROBIN | ROCK | ROCKET J. | ROCKY | ROD | ROD |
| WILLIAMS | HUDSON | SQUIRREL | BALBOA | SERLING | STEWART |
| DAYS | DAVIS, | DAVID CITY, | DANIEL BOON | DANCE | DALTON GANG |
| INN | CALIFORNIA | NEBRASKA | NATIONAL FOREST, | HALL | MUSEUM |
| | | | KENTUCKY | | |
| SCARLET | SCHOOL | SCOTCH | SCOUTMASTER | SCREAMIN' | SCREENED IN |
| RUNNER | BUS | POST-IT | | EAGLE | PORCH |
| CORNBALL | COOL AS A | COME TO | COME OUT | COME HELL | COLD |
| | CUCUMBER | ORDER | FIGHTING | AND HIGH WATER | FEET |
| THE INVISIBLE | THE IRON | THE JAGGED | THE JAZZ | THE JOY | THE JUNGLE |
| MAN | HORSE | EDGE | SINGER | OF COOKING | BOOK |
| DOUBLE-TEAM | DOUBLE-HEADER | DOUBLE | DOUBLE | DON'T BREAK | DOGLEG |
| | | PLAY | FAULT | THE ICE | |
| RODDY | ROGER | ROGER | | | |
| McDOWELL | MOORE | WHITTAKER | | | |
| DADE | CYPRESS GARDENS, | CUT KNIFE, | | | |
| COUNTY | FLORIDA | SASKATCHEWAN | | | |
| SCREW | SEA | SEALING | | | |
| JACK | GULL | WAX | | | |
| COLD AS | CLEAR | CLEAR AS | | | |
| ICE | SAILING | A BELL | | | |
| THE KARATE | THE KILLING | THE KING | | | |
| KID | FIELDS | OF KINGS | | | |
| DOG SLED | DODGEBALL | DIRT | | | |

-continued

APPENDIX - CURRENTLY PREFERRED DATA BASE WORD SETS

© J. D. Gazdick & J. J. Petrovich 1990, 1991

RACING
JANET
JACKSON
MURPHY,
NORTH CAROLINA
GRAVY
BOAT
NO GUTS,
NO GLORY
LISTEN LIKE
THIEVES
PENNY-PITCHING

JEANE
DIXON
MOSES LAKE,
WASHINGTON
GUARDRAIL

NEVER SAY
DIE

LIVING IN
THE PAST
PEANUT
VENDOR
REGGIE
JACKSON
DOWNEY,
IDAHO
RING
FINGER
DON'T BE A
LITTER BUG
THE FALL
GUY
ENGLISH
SADDLE
RICHARD
THOMAS
DOCTOR'S
OFFICE
ROLL
CALL
DIRTY
DANCING
THE GHOST AND
MR. CHICKEN
EASTER EGG
HUNT

JANIS
JOPLIN
MUNICIPAL PIER
NATIONAL PARK
GREASEPAINT

NO
DICE
LISTEN TO
THE MUSIC
PENNANT
RACE
JEFF
SMITH
MORTON,
MISSISSIPPI
GUIDED
MISSILE
NECESSITY IS THE
MOTHER OF
INVENTION
LOGAN'S
RUN
PASSING
ZONE
REX
REED
DOUGLAS,
ALASKA
RIP
CURRENT
DOG-TIRED

THE FAR
SIDE
END
ZONE
RICHIE
RICH
DIXON,
ILLINOIS
ROLL OF
FILM
DIFFERENT
DRUMMERS
THE
GODFATHER
EARNED RUN
AVERAGE

TRACK
JAYNE
KENNEDY
MOVIE
THEATER
GREEN
ONIONS
NIP IT IN
THE BUD
LITTLE HOUSE
ON THE PRAIRIE
PENN STATE
NITTANY LIONS
JEFFERSON
AIRPLANE
MORGAN HILL,
CALIFORNIA
GULF
STREAM
MY FINE-FEATHERED
FRIENDS

LONELY ARE
THE BRAVE
PASSED
BALL
RICH
LITTLE
DOUBLEDAY
FIELD
ROAST
BEEF
DO YOU FEEL
LUCKY, PUNK?
THE FELLOWSHIP OF
OF THE RING
ELECTRIC FISHING
MOTOR
RICKIE LEE
JONES
DISNEYWORLD

ROLLER
COASTER
DEAD ON
ARRIVAL
THE GODS MUST
BE CRAZY
EAGLE
CLAW

JAZZ
MUSICIAN
MOUNT RUSHMORE
NATIONAL MEMORIAL
GREETING
CARD
NINE
LIVES
LITTLE
RASCALS
PENALTY
FLAG

RICHARD
BURTON
DOOR
COUNTY
ROCK
SLIDE
DO OR
DIE
THE FLIGHT OF
THE PHOENIX
EIGHTH
POLE

JEAN PAUL
GETTY
MOUNT OLIVE,
MISSISSIPPI
GROUND
CREW
NEW YEAR'S
DAY
LITTLE
WOMEN
PENALTY
BOX

RICHARD J.
DALEY
DOG
KENNEL
ROCKING
CHAIR
DO AS I SAY,
NOT AS I DO
THE FLYING
NUN
EIGHT
BALL

JEAN
STAPLETON
MOTT,
NORTH DAKOTA
GUARDIAN
ANGEL
NEVER
SURRENDER
LIVE AND
LET DIE
PEEWEE
GOLF

RICHARD
PETTY
DODGE CITY,
KANSAS
ROD-N-REEL

DISCRETION IS THE
BETTER PART OF VALOR
THE FRONT
PAGE
EDMONTON
OILERS

BOB & DOUG McKENZIE
TRAVELER'S REST, SOUTH CAROLINA
BRICK WALL
TOO HOT TO HANDLE
BLOODY WELL RIGHT
THIN HIT
BOBBY KENNEDY
TOY STORE
BUCKBOARD

TIGER BY THE TAIL
BOY ON A DOLPHIN
THE ROSE BOWL
CAROL BURNETT
SWITCH HOUSE
CHAIN LINK FENCE
THE MIDDLE OF OF THE ROAD
CLIMB EVERY MOUNTAIN
TAKE THE NET
CATFISH HUNTER
SULLIVAN, INDIANA
CHANGING TABLE
THE LESSER OF TWO EVILS
COMING HOME
TABLE TENNIS PADDLE
MARY TYLER MOORE
HONEYMOON SUITE
MOVIE PROJECTOR

BOB BELL
TRAUMA UNIT
BRIDLE PATH
TOMORROW IS ANOTHER DAY
BLUEBERRY HILL
THE WORLD SERIES
BOBBY KNIGHT
TOOLSHED

BUGSPRAY

TIED TO THE APRON STRINGS
BRASS IN POCKET
THE PRICE IS RIGHT
CARROL O'CONNER
SWEETWATER, TENNESSEE
CHAISE LOUNGE
THE MAN'S GOT KINGS, GET YOUR TAIL OUT
CLOSE ENCOUNTERS OF A THIRD KIND
TAILING THE PACK
CAESAR ROMERO
SUGAR CITY, IDAHO
CHARCOAL LIGHTER
THE LAST ROSE OF SUMMER
CONTINENTAL DIVIDE
SYRACUSE ORANGEMEN
MASTERS & JOHNSON
HOMER, LOUISIANA
MOVING VAN

WINSTON CHURCHILL
TRAPP FAMILY LODGE
BRIMSTONE

TO ERR IS HUMAN, TO FORGIVE DIVINE
BOB AND CAROL AND TED AND ALICE
THE SUPER BOWL
BONNIE & CLYDE
TONTO NATIONAL FOREST
BULL MOOSE
TIE THE KNOT
BREAKING AWAY
THE PONTIAC SILVER DOME
CARY GRANT
SWEET HOME, OREGON
CHALKBOARD

THE LUCK OF THE DRAW
CLUTCH CARGO
TAG UP
CECIL B. DEMILLE
STUART, FLORIDE
CHARGE ACCOUNT
THE KEYSTONE STATE
COOL HAND LUKE
SYNCHRONIZED SWIMMING
MATT DILLON
HOME STAKE MINE
MR. POTATO HEAD

BOB HOPE
TRAIN STATION
BRINE SHRIMP
TIME HEALS ALL WOUNDS
BONZO GOES TO COLLEGE
THE SUGAR BOWL

CASPER THE FRIENDLY GHOST
SWAMPSCOTT, MASSACHUSETTS
CHAMBER OF COMMERCE
THE LONG AND THE SHORT OF IT
COAL MINER'S DAUGHTER
TACKLING DUMMY

MAX HEADROOM
HOLLYWOOD, CALIFORNIA
MUDPACK

BOB NEWHEART
TRAIL OF TEARS
BRITISH COMMONWEALTH
TIME FLYS WHEN YOU'RE HAVING FUN
BORN FREE
THE SEATTLE KINGDOME

CASSIUS CLAY
SUNDAY RIVER SKI AREA
CHAMPAGNE GLASS
THE LIGHT AT THE END OF THE TUNNEL
COLD TURKEY
TACKLE BOX

MAXWELL SMART
HOLLAND TUNNEL
MUFFIN PAN

BOB SEEGER & THE SILVER BULLET BAND
TRACY, MINNESOTA
BROOMSTICK

TILL DEATH DO US PART
BOY NAMED SUE
THE SADDLEDOME

CAT BURGLAR
SUN CITY, ARIZONA
CHANGE MACHINE
THE LIFE OF THE PARTY
COME RAIN OR COME SHINE
TABLE TENNIS TABLE

MCLEAN STEVENSON
HOLIDAY INN
MUSIC BOX

-continued

| | | | | | |
|---|---|---|---|---|---|
| HE HAS FRIENDS | HE ALWAYS LANDS | HAVE NOT | HAT IN | HAT | HASTE |
| IN HIGH PLACES | ON HIS FEET | WANT NOT | THE RING | IN HAND | MAKES WASTE |
| RISKY | ROAD TO | ROCK AROUND | ROLL OVER | ROLLERBALL | ROOM |
| BUSINESS | MORROCCO | THE CLOCK | BEETHOVEN | | AT THE TOP |
| IMBEDDED | ILLEGAL | ICE | I WENT TO | HUNTING | HUNTING |
| BALL | MOTION | YACHTING | THE MARKET | HORN | DOG |
| MEG | MEL | MEL | | | |
| RYAN | GIBSON | TORME | | | |
| HOLBROOK, | HODGES, | HILTON HEAD | | | |
| ARIZONA | SOUTH CAROLINA | ISLAND | | | |
| MUSTARD | NAIL | NAPKIN | | | |
| PLASTER | CLIPPERS | HOLDER | | | |
| HARD-BOILED | HARD AS | HAPPY AS A | | | |
| | NAILS | PIG IN MUD | | | |
| ROSE | RUBY | RUDOLPH, THE RED- | | | |
| GARDEN | TUESDAY | NOSED REINDEER | | | |
| HUNT THE | HULA-HOOP | HOUSTON | | | |
| SLIPPER | | ROCKETS | | | |
| CYBIL | DADDY | DAFFY | DALE | DAN | DAN |
| SHEPHERD | WARBUCKS | DUCK | EVANS | QUAYLE | WESSON |
| SNAIL SHELL | SMITH | SLEEPY EYE, | SKI | SIX RIVERS | SIX FLAGS |
| HARBOR | ISLAND | MINNESOTA | AREA | NATIONAL FOREST | GREAT AMERICA |
| COMPACT DISC | COMPASS | CONEY | CONSUMER PRICE | CONTACT | COOKIE |
| PLAYER | NEEDLE | DOG | INDEX | LENS | JAR |
| TESTING ONE, | TALK OUT OF THE | TAKEN WITH | TAKE THIS JOB | TAKE THE | TAKE THE BULL |
| TWO, THREE | SIDE OF YOUR MOUTH | A GRAIN OF SALT | AND SHOVE IT | CAKE | BY THE HORNS |
| EIGHT | EIGHT MEN | ERNEST GOES | ESCAPE FROM | EVERY WHICH WAY | EVERYTHING'S |
| IS ENOUGH | OUT | TO CAMP | ALCATRAZ | BUT LOOSE | COMING UP ROSES |
| ST. LOUIS | SQUEEZE | SPRING | SPORTS | SPOON | SPLIT |
| BLUES | PLAY | TRAINING | GLASSES | BLADE | SHOT |
| DANIEL | DARTH | DARYL | | | |
| BOONE | VADER | HANNAH | | | |
| SILVER | SIGOURNEY, | SIDNEY, | | | |
| MINE | IOWA | NEBRASKA | | | |
| COONSKIN | CORAL CORDLESS | | | | |
| CAP | SNAKE | DRILL | | | |
| TAKE IT | TAKE | TAKE A | | | |
| LIKE A MAN | FIVE | HIKE | | | |
| EVIL | EYE OF | FAIL | | | |
| WOMAN | THE TIGER | SAFE | | | |
| SPLIT IN | SPINNING REEL | SPIN THE | | | |
| THE OCEAN | | BOTTLE | | | |
| MIKE | MILL | MILTON | MILTON | MINNIE | MINNIE |
| WALLACE | RAT | BERLE | BRADLEY | MOUSE | PEARL |
| HARTFORD, | HARPER'S | HARMONY | HARDROCK | HAPPY JACK, | HANGING GARDENS |
| CONNECTICUT | FERRY | HALL | CAFE | ARIZONA | OF BABYLON |
| OARLOCK | OIL | OLD | OLIVE | ONION | OPEN-FACED |
| | PAINTING | STYLE | PIT | RING | SANDWICH |
| GOOD-BYE | GOOD | GONE BUT NOT | GOD IS ON | GOD HELPS THOSE | GOD BLESS |
| | FRIDAY | FORGOTTEN | OUR SIDE | WHO HELP THEM- | YOU |
| | | | | SELVES | |
| SHADOW OF A | SHAKE, RATTLE & | SHARE | SHOW ME | SILENT | SINGIN' |
| DOUBT | ROLL | THE LAND | THE WAY | NIGHT | IN THE RAIN |
| HIT-AND- | HIT FOR | HIP | HIP | HIKING | HIKING |

-continued

| | | | | | |
|---|---|---|---|---|---|
| RUN | THE CYCLE | PADS | CHECK | TRAIL | BOOTS |
| MISS | MISS | MISS | | | |
| AMERICA | KITTY | SCARLET | | | |
| HANCOCK, | HAMPTON MARINER'S | HALL OF | | | |
| MARYLAND | MUSEUM | CONGRESS | | | |
| OVEN | OWNER'S | OYSTER | | | |
| MITT | REGISTRATION CARD | CRACKERS | | | |
| GO FLY | GO AHEAD, | GIVE UP | | | |
| A KITE | MAKE MY DAY | WITHOUT A FIGHT | | | |
| SINK | SKIN | SMOKE GETS IN | | | |
| THE BISMARK! | TIGHT | YOUR EYES | | | |
| HIGH-STICKING | NFL | HIGH | | | |
| | PRIME TIME | DIVE | | | |
| KAREN | KAREN | KARL | KATE | MAE | PEPE |
| BLACK | CARPENTER | MARX | JACKSON | WEST | LE PEW |
| LONGHORN CAVERNS | LONG | LONDON, | LONDON BRIDGE, | ISLAND POND, | FORT WAYNE, |
| STATE PARK | BEACH | ENGLAND | ARIZONA | VERMONT INDIANA | |
| JUMP | JUNKYARD | KENTUCKY | KEY | MEAT | POPCORN |
| SUIT | | BLUEGRASS | RING | CLEAVER | |
| LEAD BY | LEAD A CHARMED | LAY | LAND OF | HOLY | EVERY CLOUD HAS |
| EXAMPLE | LIFE | OFF | THE FREE | COW | A SILVER LINING |
| NICE | NIGHT | NINE TO | NOBODY DOES | PUPPET ON | THE 7TH VOYAGE |
| DREAMS | GALLERY | FIVE | IT BETTER | A STRING | OF SINBAD |
| MONTE | MONKEY IN | MONEY | MIXED | KICK | FRONT |
| CARLO | THE MIDDLE | BALL | DOUBLES | BOXER | FOUR |
| PETER | PHILIP | TY | | | |
| FINCH | MORRIS | COBB | | | |
| FORT | FLAGSTAFF, | BALLPARK | | | |
| CASPER | ARIZONA | | | | |
| POSTER | PROPANE | VIDEOCASSETTE | | | |
| BOARD | GRILL | RECORDER | | | |
| EAT LIKE | DUTCH | ACCIDENT-PRONE | | | |
| A BIRD | TREAT | | | | |
| THE BEVERLY | THE BRIDE | WHAT I | | | |
| HILLBILLIES | OF FRANKENSTEIN | LIKE ABOUT YOU | | | |
| FREE | FLY | BACKSTROKE | | | |
| AGENT | FISHING | | | | |
| DICK | DIRE | DISC | DIZZY | DOC | DOLLY |
| VAN DYKE | STRAITS | JOCKEY | DEAN | HOLLIDAY | MADISON |
| SCOTTSDALE, | SCOTCH PLAINS, | SCOOBA, | SCHOOL | SCENE OF | SARATOGA NATIONAL |
| ARIZONA | NEW JERSEY | MISSISSIPPI | CAFETERIA | THE ACCIDENT | HISTORIC PARK |
| CROCK | CUFF | CUPCAKE | CURLING | CURTAIN | CUSTOM |
| POT | LINKS | LINERS | IRON | ROD | VAN |
| STOP AND SMELL | STILL WATERS | STIFF AS | STICKS AND | STICK LIKE | STEADY AS |
| THE ROSES | RUN DEEP | A BORAD | STONES | GLUE | AS A ROCK |
| FLOWERS IN | FOLLOW THE | FOOLS RUSH | FOR A FEW | FOR WHAT | FORCE 10 |
| THE DIRT | SUN | IN | DOLLARS MORE | IT'S WORTH | FROM NAVARONE |
| SNAKES AND | SLOT | SLOT CAR | SLIP | SLAPJACK | SLAP |
| LADDERS | MACHINE | RACING | BOBBER | | SHOT |
| DOLLY | DON | DONALD | | | |
| PARTON | KNOTTS | DUCK | | | |
| SANTA CLAUS, | SANDY HOOK, | SANDWICH, | | | |
| INDIANA | CONNECTICUT | MASSACHUSETTS | | | |
| DADDY-LONGLEGS | DATABASE | DAY-OLD | | | |

-continued

STATE OF THE ART

FRANKENSTEIN
MEETS THE WOLFMAN
SLAM
DUNK
JIMMY
THE GREEK
MILTON,
PENNSYLVANIA
HATCHBACK

MEET YOUR
MAKER
MAD MAX BEYOND
THE THUNDERDOME
ON DECK
CIRCLE
JOE
COOL
MICHIGAN SPACE
CENTER
HELLHOLE

MAN ON
THE MOON
MAKE ME
SMILE
ODD AND
EVEN
HARVEY
KORMAN
ORANGE
COUNTY
FOOD
CHAIN
PAT ON
THE BACK
IT'S ALL
IN THE GAME
PROVISIONAL
BALL
HENRY
FORD
OLD HICKORY,
TENNESSEE
FRENCH
HORN
OVEREASY

JINGLE
BELLS
POWERBOAT

STAND ON YOUR
OWN TWO FEET
FREE
BIRD
SLALOM
COURSE
JOAN
VAN ARK
MILL CREEK
STATE PARK
HAYSTACK

MEEK AS
A LAMB
MAGIC
CARPET RIDE
OLYMPIC
MEDAL
WOODY
HAYES
MIAMI
BEACH
HEREAFTER

MAN DOES NOT LIVE
BY BREAD ALONE
MAKE ROOM
FOR DADDY
OCEAN
PACIFIC
HAWKEYE
PIERCE
OPERATING
ROOM
FOOTLOCKER

PASS THE
HAT
IT'S NOT FOR
ME TOO SAY
PROFESSIONAL GOLF
ASSOCIATION
HENRY
THE EIGTH
OLD
FAITHFUL
FRIED
MUSHROOMS
OUT-OF-DATE

JOE
KIDD
POWER

BREAD
SQUASHED LIKE
A BUG
FREE FOR
ALL
SKY
HOOK
JOAN
CRAWFORD
MILK RIVER,
ALBERTA
HEADACHE

MEDIUM-WELL

MAGIC
MAN
OLYMPIC
GAMES
JOE
JACKSON
MGM GRAND
STUDIOS
HERRINGBONE
CHAIN
MAKE ENDS
MEET
MARATHON
MAN
OAKLAND
ATHLETICS
HAYLEY
MILLS
OMAHA,
NEBRASKA
FORKLIFT

PASS
OUT
JACK AND
THE BEANSTALK
PRO SHOP

HERMAN
MUNSTER
OLD BROWN HOUSE
DOLL MUSEUM
FROSTY
MUG
OUT ON A
LIMB
JOHNNY B.
GOODE
POWDER

JOAN OF
ARK
MIDWAY
AIRPORT
HEARTACHE

MEDIUM-RARE

MAGNUM
FORCE
OLD
MAID

HEAD
NURSE
OLYMPIC
NATIONAL PARK
FOUR-LEAF
CLOVER
PARTING IS SUCH
SWEET SORROW
JAILHOUSE
ROCK
PRO BOWL

JOAN
RIVERS
MIDDLESEX,
CONNECTICUT
HEAT
WAVE
MEATHEAD

MAJOR
DAD
OFFSIDES

HELEN
REDDY
OLIVIA,
MINNESOTA
FOX
HUNT
PARDON OUR
DUST
JERIHMIAH
JOHNSON
PREVENT
DEFENSE

JODIE
FOSTER
MIDAS,
NEVADA
HEDGE
TRIMMER
MAN'S
BEST FRIEND
MAJOR
LEAGUE
ODDS-ON
FAVORITE

HENNY
YOUNGMAN
OLD NORTH
CHURCH
FREAK
SHOW
PAPER-THIN

JET
AIRLINER
PRESS
BOX

-continued

| | | | | | |
|---|---|---|---|---|---|
| RACING | LIFTER | SNOW | | | |
| GOLDIE | GOMER | GORDIE | GRACE | GRACE | GRACIE |
| HAWN | PYLE | HOWE | JONES | SLICK | ALLEN |
| PEARL | PEABODY, | PAYNE, | PAUL BUNYAN | PARSONS, | PARKER, |
| HARBOR | KANSAS | OHIO | CENTER | KANSAS | SOUTH DAKOTA |
| FILE | FILM | FINE | FINGER | FIRE | FIRST |
| FOLDER | FESTIVAL | CHINA | PAINTING | EXTINGUISHER | COMMUNION |
| PRIME DRINKING | PRIDE GOES | PRIDE AND | PRETTY AS | PRACTICE WHAT | PRACTICE MAKES |
| TIME | BEFORE A FALL | JOY | A PICTURE | YOU PREACH | PERFECT |
| I SAW MOMMY | I SHOULD | I TALK TO | I'LL BE | I'M JUST | I'VE GOT YOU |
| KISSING SANTA CLAUS | HAVE KNOWN BETTER | THE TREES | SEEING YOU | WILD ABOUT HARRY | UNDER MY SKIN |
| RIGHT | RICK | REVERSE | RELIEF | RELAY | RED LIGHT, |
| CROSS | MEARS | ENGLISH | PITCHER | RACE | GREEN LIGHT |
| GRAHAM | GRAHAM | GRANT | | | |
| CHAPMAN | PARKER | TINKER | | | |
| PARK | PARIS, | PANAMA | | | |
| PLACE | FRANCE | CANAL | | | |
| FISH | FLAGPOLE | FLASHLIGHT | | | |
| FRY | | | | | |
| POWER | PLEASED AS | PLAYING BOTH ENDS | | | |
| LUNCH | PUNCH | AGAINST THE MIDDLE | | | |
| ICE STATION | IF I | IMMIGRANT | | | |
| ZEBRA | DIDN'T CARE | SONG | | | |
| RANGE | RAINED | RAIN | | | |
| OFFICER | OUT | DELAY | | | |
| PETER | PETER | PETER | PETER, PAUL, AND | PETTY | PHIL |
| GRAVES | PAN | PIPER | MARY | THIEF | COLLINS |
| FOOD CIRCUS INTER- | FLOYD, | FLORIDA | FLORENCE, | FLINTSONE, | FLAMINGO HILTON |
| NATIONAL FOUNTAIN | VIRGINIA | KEYS | KENTUCKY | MARYLAND | HOTEL & CASINO |
| POWER | PRAIRIE | PRECIOUS | PRETZEL | PRIMARY | PRIME |
| BLOWER | CHICKEN | MOMENTS | STICK | ELECTION | RIB |
| EAST IS EAST, | EASIER SAID | EARTH | EARLY TO BED, | EAGLE-EYED | DYED-IN- |
| WEST IS WEST | THAN DONE | DAY | EARLY TO RISE | | THE-WOOL |
| THE BIRTH | THE BLUE | THE BOSTON | THE BOUNTY | THE BOYS | THE BRADY |
| OF A NATION | LAGOON | STRANGLER | HUNTER FROM BRAZIL | BUNCH | |
| FORWARD | FOOTBALL | FOOT | FOOD | FOLLOW | FLYWEIGHT |
| PASS | FIELD | BAG | FIGHT | THE LEADER | CHAMP |
| PHIL | PHYLLIS | PLAIN CLOTHES | | | |
| DONAHUE | DILLER | DETECTIVE | | | |
| FLAMING GORGE | FITZGERALD, | FISHERMAN'S | | | |
| RESERVOIR | GEORGIA | WHARF | | | |
| PRINTING PRESS | PUBLIC STORAGE | PUMPKINSEED | | | |
| DUTY BEFORE | DUKE IT | DRY YOUR | | | |
| DISHONOR | OUT | EYES | | | |
| THE BREAKFAST | THE BRIDGE ON THE | THE BULLWINKLE | | | |
| CLUB | RIVER KWAI | SHOW | | | |
| FLYING | FLASHLIGHT | FLAK | | | |
| RINGS | TAG | JACKET | | | |
| JOHN | JOHN | JOHN | JOHN PAUL | JOHN PHILIP | JOHN |
| LENNON | MONROE | McENROE | JONES | SOUSA | RAMBO |
| MARATHON, | MANY, | MANSFIELD, | MAMMOTH CAVE | MALIBU | MALDEN, |
| FLORIDA | LOUISIANA | OHIO | NATIONAL PARK | BEACH | MISSOURI |
| HUMMINGBIRD | ICE | IMPACTED WISDOM | INDOOR | INFLATION | INKWELL |
| | CUBES | TOOTH | PLUMBING | RATE | |

-continued

| | | | | | |
|---|---|---|---|---|---|
| LIVING ON THE EDGE | LIVE OFF OF THE LAND | LIVE AND LET LIVE | LITTLE PITCHERS HAVE BIG EARS | LISTEN TO YOUR HEART | LIKE WATER OFF A DUCK'S BACK |
| MOON RIVER | MOONLIGHTING | MOONRAKER | MOONSTRUCK | MOSCOW ON THE HUDSON | MOTHER'S LITTLE HELPER |
| NEW JERSEY NETS | NEW JERSEY DEVILS | NEW ENGLAND PATRIOTS | NECK AND NECK | NEBRASKA CORNHUSKERS | NATIONAL HOT ROD ASSOCIATION |
| JOHN THE BAPTIST | JOHN TYLER | JOHN WAYNE | | | |
| MAINE SCHOOL FOR THE DEAF | MAIN STREET | MAGEE, MISSISSIPPI | | | |
| INSTANT CAMERA | INSTRUMENT PANEL | INVESTMENT FUND | | | |
| LIKE THERE'S NO TOMORROW | LIKE TAKING CANDY FROM A BABY | LIKE FATHER, LIKE SON | | | |
| MOVIN' ON | MR. ROGERS' NEIGHBORHOOD | MRS. ROBINSON | | | |
| NATIONAL FOOTBALL LEAGUE | NATIONAL BASKET-BALL ASSOCIATION | NAME THAT TUNE | | | |
| PROFESSOR PLUM | PUNCH AND JUDY | QUEEN ELIZABETH | QUICK DRAW McGRAW | RAE DAWN CHONG | RAGGEDY ANN & ANDY |
| ESTES NATIONAL PARK | EROS DATA CENTER | ERICK, OKLAHOMA | EPCOT CENTER | ELLIOTT, SOUTH CAROLINA | ELIZABETHTOWN, KENTUCKY |
| RADIO WAVE | RAGDOLL | RAIN FOREST | RANCH HOUSE | RAPID EYE MOVEMENT | RATTRAP |
| DOUGHNUT HOLE | DOUBLESPEAK | DOUBLE YOU PLEA-SURE, DOUBLE YOU FUN | DON'T TREAD ON ME | DON'T TAKE NO FOR AN ANSWER | DON'T SPILL THE BEANS |
| THE COURTSHIP OF EDDIE'S FATHER | THE DAY OF THE JACKAL | THE DAY THE EARTH STOOD STILL | THE DEAD ZONE | THE DEER HUNTER | THE DEFIANT ONES |
| FIGURE EIGHT | FIFTY-YARD LINE | FIELDER'S CHOICE | FIELD GOAL | FENWAY PARK | FEATHERWEIGHT CHAMP |
| RALPH KRAMDEN | RALPH LAUREN | RALPH NADAR | | | |
| ELEPHANT ROCKS STATE PARK | EIFFEL TOWER | EGG HARBOR CITY, NEW JERSEY | | | |
| RAWHIDE CHEW | REAR-VIEW MIRROR | RECOVERY ROOM | | | |
| DON'T PUT THE CART BEFORE THE HORSE | DON'T MAKE ME LAUGH | DON'T JUMP TO CONCLUSIONS | | | |
| THE DEVIL AND DANIEL WEBSTER | THE DIARY OF ANNE FRANK | THE DIRTY DOZEN | | | |
| FAST BREAK | FALSE START | FALL LINE | | | |
| IRON MIKE DITKA | ISAAC NEWTON | J. R. EWING | JACK BENNY | JACK BRICKHOUSE | JACK LEMMON |
| NILE RIVER | NICHOLASVILLE, KENTUCKY | NIBLETTS BLUFF STATE PARK | NIAGARA FALLS | NEWGATE PRISON | NEW YORK STOCK EXCHANGE |
| GARTER SNAKE | GAS FILTER | GEARBOX | GEMSTONE | GERMAN CHOCOLATE CAKE | GET WELL CARD |
| ONCE IN A WHILE | ON THIN ICE | ON THE RAZOR'S EDGE | OLD-FASHIONED | OLD GOAT | OLD GLORY |
| LADY AND THE TRAMP | LADY IN A CAGE | LADY OF SPAIN | LAND OF THE GIANTS | LAND OF THE LOST | LAST CHILD |
| POLE | POKER | POCKET | PLAY | PLAY IT WHERE | PLASTIC |

-continued

| | | | | | |
|---|---|---|---|---|---|
| MALLET | FACE | BILLIARDS | OFF | IT LIES | WORM |
| JACK | JACKIE | JACKIE | | | |
| LONDON | MASON | ONASSIS KENNEDY | | | |
| NEW SHARON, | NEW RIVER | NELSON | | | |
| MAINE | PARK | ART GALLERY | | | |
| GETTYSBURG | GIANT | GIN AND | | | |
| ADDRESS | PANDA | TONIC | | | |
| OLD | OFF HIS | NOWHERE TO | | | |
| BATTLE-AXE | ROCKER | HIDE | | | |
| LAST TANGO | LAUGH! CLOWN! | LAY LADY | | | |
| IN PARIS | LAUGH! | LAY | | | |
| PITTSBURGH | PITTSBURGH | PITCHOUT | | | |
| PIRATES | PENGUINS | | | | |
| BUD ABBOTT AND | BUDDY | BUFFALO | BUGS | BUGSY | BULLFIGHTER |
| LOU COSTELLO | HOLLY | BILL | BUNNY | MALONE | |
| THE ROCK OF AGES | THE PARK | THE OREGON | THE LINCOLN | THE LAND | THE HEARTLAND OF |
| QUARRY | WEST | TRAIL | TUNNEL | OF OZ | AMERICA |
| CANDY | CAP AND | CAPITAL | CAPTAIN'S | CAR | CARD |
| CANE | GOWN | PUNISHMENT | CHAIR | ALARM | TABLE |
| THERE IS NO FIRE | THE WORM | THE WOLF IS AT | THE WILD | THE WHOLE BALL | THE WELL |
| WITHOUT SOME SMOKE | TURNS | THE DOOR | BLUE YONDER | OF WAX | RUNS DRY |
| CALIFORNIA | CALL ON | CAN'T BUY | CAR 54, | CASUALTIES | CAT ON A |
| DOLLS | ME | ME LOVE | WHERE ARE YOU? | OF WAR | HOT TIN ROOF |
| TEXAS | TEXAS | TEST | TENNIS | TENNIS | TENDERFOOT |
| RANGERS | LONGHORNS | MATCH | ELBOW | COURT | |
| BULLWINKLE T. | BURGESS | BURT | | | |
| MOOSE | MEREDITH | PARKS | | | |
| THE GREAT PYRAMIDS | THE FRENCH | THE ENGLISH | | | |
| OF EGYPT | QUARTER | CHANNEL | | | |
| CARPET | CARROT | CARTWHEEL | | | |
| SWEEPER | CAKE | | | | |
| THE WEAKER | THE WALLS | THE TWIN | | | |
| SEX | HAVE EARS | CITIES | | | |
| CAT | CATCHER IN | CATHY'S | | | |
| PEOPLE | THE RYE | CLOWN | | | |
| TEN POINT | TELESCOPIC | TEETER-BOARD | | | |
| SYSTEM | SIGHT | | | | |
| MAJORITY | MAMA | MAMIE | MARC | MARGARET | MARILYN |
| WHIP | CASS ELLIOT | EISENHOWER | ANTONY | THATCHER | CHAMBERS |
| IRISH HILLS, | INTERNATIONAL | INTERCOSTAL | INDIANA DUNES | INDIAN | INDEPENDENCE |
| MICHIGAN | FALLS, MINNESOTA | WATERWAY | NATIONAL LAKESHORE | OCEAN | HALL |
| MEDICINE | MESS | METAL | MILK | MILKBONES | MILLER |
| CHEST | KIT | SHOP | DUDS | | LITE |
| HOGTIED | HIT THE NAIL | HIT | HIT | HISTORY | HIS BARK IS WORSE |
| | ON THE HEAD | THE BRICKS | ROCK BOTTOM | REPEATS ITSELF | THAN HIS BITE |
| PUSS | PUT YOUR HEAD | QUARTER | RADAR | RAIDERS OF THE | RAIN |
| IN BOOTS | ON MY SHOULDER | TO THREE | LOVE | LOST ARK | MAN |
| KANSAS | KANSAS CITY | JUMPING | JUMP | JOE ROBBIE | JOCKEY |
| JAYHAWKS | CHIEFS | JACKS | ROPE | STADIUM | CLUB |
| MARILYN | MARILYN | MARIO | | | |
| MONROE | QUAYLE | ANDRETTI | | | |
| HYDE | HURRICANE | HUNGRY HORSE | | | |
| PARK | RIDGE | POWER DAM | | | |
| MILLSTREAM | MINERAL | MINT | | | |

-continued

| | | | | | |
|---|---|---|---|---|---|
| HINDSIGHT IS | WAX | JELLY | | | |
| 20/20 | HIGH AS | HEY | | | |
| RAIN RAIN | A KITE | MAN | | | |
| GO AWAY | RAINDROPS KEEP FAL- | RAISING | | | |
| JACKS | LIN' ON MY HEAD | ARIZONA | | | |
| OR BETTER | JACKKNIFE | IVY | | | |
| LITTLE | | LEAGUE | | | |
| JACK HORNER | LITTLE | LITTLE | LITTLE RED | LIZZIE | LLOYD |
| KILL DEVIL | MISS MUFFETT | ORPHAN ANNIE | RIDING HOOD | BORDEN | BRIDGES |
| HILL | KEY WEST, | KEY STONE, | KERMIT, | KENTUCKY | KENNYWOOD |
| LONG ISLAND | FLORIDA | SOUTH DAKOTA | TEXAS | LAKE | PARK |
| ICED TEA | LONG-STEMMED | LOWLAND | LUCKY | LUG | LUGGAGE |
| IN THE | ROSES | | CHARM | NUT | RACK |
| RIGHT | IN THE | IN THE BLINK | IN THE | IF LOOKS | I'M ALL |
| PEACE | DOGHOUSE | OF AN EYE | BAG | COULD KILL | THUMBS |
| TRAIN | PEE-WEE'S | PENNIES | PERFECT | PET | PETTICOAT |
| LIFE | BIG ADVENTURE | FROM HEAVEN | STRANGERS | CEMETERY | JUNCTION |
| PRESERVER | LIFE | LIAR'S | LET'S MAKE | LEFT | LEFT |
| LOIS | CYCLE | POKER | A DEAL | WING | HOOK |
| LANE | LONG DISTANCE | LORETTA | | | |
| KENNEDY | RUNNER | LYNN | | | |
| SPACE CENTER | JUNK | JOSHUA TREE | | | |
| LUNCH | YARD | NATIONAL MONUMENT | | | |
| BOX | LUNGFISH | MACARONI AND | | | |
| I'D WALK A MILE | | CHEESE | | | |
| FOR A CAMEL | I WENT TO SEE A | I SMELL | | | |
| PICK UP | MAN ABOUT A HORSE | A RAT | | | |
| THE PIECES | PILLOW | PLACES IN | | | |
| LEADOFF | TALK | THE HEART | | | |
| MAN | LAY ONE | LAY ON | | | |
| PAUL | DOWN | YOUR OARS | | | |
| BUNYON | PAUL | PAUL | PEARL | PEE-WEE | PENN & |
| FRENCH LICK, | McCARTNEY | SHAFER | BAILEY | HERMAN | TELLER |
| INDIANA | FREEDOM | FREDERICK, | FRANKLIN, | FOUR CORNERS, | FORT WORTH, |
| POLAR | TRAIL | MARYLAND | IDAHO | OREGON | TEXAS |
| BEAR | POLICE | POLISH | POLL | PONTOON | POOL |
| FAIR | SCANNER | HAM | TAX | BOAT | SKIMMER |
| FIGHT | FACE | EYES IN THE BACK | EYE OF THE | EXIT, | EVERY DOG |
| TELL ME | THE MUSIC | OF HIS HEAD | TIGER | STAGE LEFT | HAS HIS DAY |
| WHY | TEN MEN | TENNESSEE | TERMS OF | THANK GOD | THAT OLD |
| GAME | WORKIN' | WALTZ | ENDEARMENT | I'M A COUNTRY BOY | BLACK MAGIC |
| ANIMAL | FUNNY | FULL | FULL | FROZEN | FRONT |
| PEPPERMINT | CAR | NELSON | HOUSE | ROPE | FOUR |
| PATTY | PERRY | PERRY | PETE | YOGI | PETER |
| FORT SCOTT, | COMO | MASON | ROSE | BERRA | GABRIEL |
| KANSAS | FORT LAUDERDALE, | FORT | FORT HAYES, | FORREST, | FORD |
| PORKCHOP | FLORIDA | KNOX | KANSAS | ILLINOIS | COUNTY |
| | PORT | POST OFFICE | POSTAGE | POTATO | POTS AND |
| EGG ON | OF CALL | BOX | STAMP | SALAD | PANS |
| YOUR FACE | EDUCATION | EAT, DRINK | EAT LIKE | EAT | EASY COME, |
| THE ACCIDENTAL | MAKES THE MAN | AND BE MERRY | A PIG | DIRT | EASY GO |
| TOURIST | THE AFRICAN | THE BEST YEARS | THE BIG | THE BIG | THE BIONIC |
| FRENCH | QUEEN | OF OUR LIVES | EASY | RED ONE | WOMAN |
| | FREE | FREE | FOX | FOURSOME | FOUL |

-continued

DRAW
PHILIP
MORRIS
FLAGSTAFF,
ARIZONA
PROPANE
GRILL
DUTCH
TREAT
THE BRIDE OF
FRANKENSTEIN
FLY
FISHING
PORKY
PIG
FANNIE MAE
CANDY STORE
QUICKSAND

DRAW A
BEAD
THE CHARGE OF THE
LIGHT BRIGADE
FIRST AND
GOAL
GREG
NORMAN
PALM SPRINGS,
CALIFORNIA
FLAT
TIRE
PLAY THE
FIELD
IMMIGRATION
MAN
RAQUETBALL
COURT
HANNA &
BARBERA
OYSTER BAY,
NEW YORK
FLOWER
BED
PHYSICIAN,
HEAL THYSELF
INDIANA
WANTS ME
QUARTERBACK

MISS
U.S.A.
GULF SHORES,
ALABAMA
PABST BLUE

THROW
POLICE
OFFICER
FISH & GAME
REFUGE
PURPLE
HEART
DRY AS
A BONE
THE BURNING
BED
FLAGSTICK

PRINCE
CHARLES
FAIRHOPE,
ALABAMA
QUILTING
BEE
DOWN TO
EARTH
THE CHINA
SYNDROME
FIRING

GREGORY
PECK
PAINTED
CLIFFS
FLEA
COLLAR
PLAN
AHEAD
IN COLD
BLOOD
RACING
FORM
HARDROCK, COCO
AND JOE
OXNARD,
CALIFORNIA
FLYING
SAUCER
PHONE
HOME
INVASION OF THE
BODY SNATCHERS
PUTTING
GREEN
MISTER
ED
GUARD
TOWER
PADDLE

SAFETY
PONCHO
CARTER
FIFTH
AVENUE
PUSH-BUTTON
PHONE
DRUNK AS
A SKUNK
THE CAINE
MUTINY
FIVE CARD
STUD
PRINCE
CHARMING
FAIRBANKS,
ALASKA
QUOTATION
MARK
DOWN ON
YOUR LUCK
THE CHRISTMAS
SONG
FINISH

GROUCHO
MARX
PAGE,
NORTH DAKOTA
FLIGHT
ATTENDANT
PINS AND
NEEDLES
IN HARM'S
WAY
RACE
WALKING
HARLEM
GLOBETROTTERS
OUTBACK

FOAM
RUBBER
PENNY FOR
YOUR THOUGHTS
IRON
EAGLE
PUT AND
TAKE
MISTER GREEN
JEANS
GREEN BAY,
WISCONSIN
PALM

HUNTING
PONTIOUS
PILOT
FIELD
MUSEUM
PUTTY
KNIFE
DRIVING UNDER
THE INFLUENCE
THE CALL OF
THE WILD
FISH
FINDER
PRISCILLA
PRESLEY
EVERGLADES
NATIONAL PARK
RABBITS
FOOT
DOWN IN
THE DUMPS
THE CINCINNATI
KID
FINISH

GUNS-N-ROSES

PADRE ISLAND
NATIONAL SEASHORE
FLOOR
LAMP
PINHEAD

IN LIVING
COLOR
RABBIT
PUNCH
HARPO
MARX
OTTER CREEK
PARK
FOG
BANK
PEDAL TO
THE MEDAL
IRON
MAN
PUSH-UPS

MISTER
ROGERS
GREAT NECK,
NEW YORK
PANAMA JACK

POPE
JOHN PAUL
FAWNTAIL,
COLORADO
QUARTZ
WATCH
DRINK LIKE
A FISH
THE CAROL
BURNETT SHOW
FIRST ROUND
DRAFT CHOICE
PRISONER
OF WAR
EVENING SHADE,
ARKANSAS
RACK OF
LAMB
DOWN FOR
THE COUNT
THE COLOR
OF MONEY
FINGERTIP

HACK
WILSON
PACIFIC
OCEAN
FLOPPY
DISK
PIGHEADED

IN THE HEAT OF
THE NIGHT
QUEBEC
NORDIQUES
HARRY
BLACKSTONE JR.
OSBORNE,
KANSAS
FOLDING
CHAIR
PEACE ON EARTH,
GOODWILL TO MEN
IT HAPPENED
ONE NIGHT
PUNT
RETURN
MOE
HOWARD
GREAT BARRIER
REEF
PANCAKE

LINE
POPEYE THE
SAILOR MAN
FARGO,
NORTH DAKOTA
QUEEN
ANT
DRESSED
TO KILL
THE CAT
IN THE HAT
FIRST
BASE
PRIVATE
EYE
EUNICE,
LOUISIANA
RADAR
DETECTOR
DOWN AND
OUT
THE COUNT OF
MONTE CRISTO
FILLET
KNIFE
HANK
ARRON
OZARK
NATIONAL FOREST
FLOTATION
DEVICE
PIG IN A
BLANKET
IN THE
MIDNIGHT HOUR
QUARTERFINALS

HARRY
CARAY
ORLANDO,
FLORIDA
FOLK
DANCE
PEACE BE
WITH YOU
IT'S A
WONDERFUL LIFE
PULL THE
STRING
MOLLY
McGEE
GRAY,
MAINE
PANTY

-continued

RIBBON
GIVE UP
THE GHOST
SNOOPY VS.
THE RED BARON
HIDE-AND-SEEK

MOLLY
RINGWALD
GRAVEYARD

PAPERWEIGHT

GENTLE AS
A LAMB
SOUTH
PACIFIC
HARTFORD
WHALERS
JOE
MONTANA
MEDICINE HAT,
ALBERTA

HIGH
HEELS
MAKE A
BEELINE
MARCUS WELBY,
M.D.
NOTRE DAME
FIGHTING IRISH
JOHN
CARPENTER
MARSHALL,
ILLINOIS
HOOK AND
LADDER
LOSE YOUR
BEARINGS
MIRCLE ON
34TH STREET
NIGHT
CRAWLER
LAUREN
BACALL
LAKE MEAD NATION-
AL RECREATION AREA
LEMONADE
STAND
JUST THE FACTS,
MA'AM
OVER
MY HEAD

BOAT
GIVE ME
A HAND
SNOW WHITE AND
THE SEVEN DWARFS
HEAVYWEIGHT
CHAMP
MORRIS THE
CAT
GRANT'S
TOMB
PARTY
HAT
FUNNY AS
A CRUTCH
SOUTHERN
MAN
HARNESS
RACING
JOE
PETROVICH
MAYO
CLINIC

HIP
JOINT
MADE-TO-ORDER

ME AND
MY SHADOW
NOSE
TACKLE
JOHN COUGAR
MELLENCAMP
MARSHALL
FIELD'S
HORNED
TOAD
LOOSE LIPS
SINK SHIPS
MISSION:
IMPOSSIBLE
NICKEL
DEFENSE
LAWRENCE
WELK
LAKE
COUNTY
LETTERHEAD

JUST
DO IT
OVER
THE RAINBOW

LEAF
GIFT OF
GAB
SOME ENCHANTED
EVENING
HEADPIN

MORTON
DOWNEY JR.
GRANT PARK,
CHICAGO
PASSENGER
SEAT
FULL OF
BEANS
SPANISH
HARLEM
HANGMAN

JOHANN
SABASTIAN BACH
MAX,
NORTH DAKOTA

HOEDOWN

MADE IN
THE SHADE
MEDICAL
CENTER
NORTH CAROLINA
TARHEELS
JOHN
DAVIDSON
MARLBOROUGH,
CONNECTICUT
HORROR
FILM
LOOKS CAN BE
DECEIVING
MISSISSIPPI
BURNING
NEW YORK
KNICKS
LEE HARVEY
OSWALD
LAKE ARTHUR,
LOUISIANA
LIE
DETECTOR
JUMP ON THE
BANDWAGON
OZZIE AND
HARRIET

BEACHWEAR
GET OFF YOUR
HIGH HORSE
SOME LIKE
IT HOT
HEAD FIRST
SLIDE
MOTHER
GOOSE
GRANITE CITY,
ILLINOIS
PASTEURIZED
MILK
FREE AS
A BIRD
SPIES LIKE
US
HANG
GLIDER
JOHN
ADAMS
MASSACHUSETTS
INSTITUTE OF
TECHNOLOGY
HOLDUP

LUCKY
DUCK
MIAMI
VICE
NORDIC
TRACK
JOHN F.
KENNEDY
MARKS
MISSISSIPPI
HOT AIR
BALLOON
LOOK OUT
BELOW
MOBY
DICK
NEW YORK
ISLANDERS
LEE
MARVIN
LADYSMITH,
WISCONSIN
LIFELINE

JOHNNY-
ON-THE-SPOT
PAINT
YOUR WAGON

BATTER
GET OFF
MY BACK
SOMEBODY UP THERE
LIKES ME
HAT
TRICK
MOTHER
NATURE
GRAND CENTRAL
STATION
PATIO
BRICKS
FRANKLY MY DEAR,
I DON'T GIVE A DAMN
SLENDOR IN
THE GRASS
HANDBALL

JOHN
BIRCH
MARTIN,
TENNESSEE

HONEYBEE

LOVE YOUR
ENEMIES
MIDNIGHT
COWBOY
NINETEENTH
HOLE
JOHN
HOUSEMAN
MARK TWAIN
NATIONAL FOREST
HOUSECOAT

LOOK BEFORE
YOU LEAP
MOHAIR
SAM
NEW YORK
GIANTS
LEE
TREVINO
LADY LUCK
HOTEL & CASINO
LIGHT
BEER
JACK-
OF-ALL-TRADES
PALE
RIDER

HOSE
GET IN ON
THE GROUND FLOOR
SONG SUNG
BLUE
HASH
LINES
MR.
MAGOO
GRAND
CANYON
PEANUT
BUTTER
FOUL-MOUTHED

SPORTS
ILLUSTRATED
HAMMER
TOSS
JOHN
CANDY
MARTHA'S
VINEYARD

HOOD
ORNAMENT
LOST BUT
NOT FORGOTTEN
MIDNIGHT
EXPRESS
NIGHT
GAME
JOHN
HOUSTON
MARBLE MOUNTAIN
FOREST
HUBCAP

LOCKED AND
LOADED
MONTY PYTHON'S
FLYING CIRCUS
NEW ORLEANS
SAINTS
LENA
HORNE
L. B. J.
SPACE CENTER
LILY
PAD
IT'S THE
REAL THING
PANIC IN
THE STREETS

-continued

LOS ANGELES
KINGS
LENNY
BRUCE
KODIAK ISLAND,
ALASKA

LIMITED
MENU
IT'S ALWAYS DARKEST
BEFORE THE DAWN
PAPA'S GOT A
BRAND NEW BAG
LOCKER
ROOM
B. F.
GOODRICH
WALNUT RIDGE,
ARKANSAS
BASS
VIOLIN
WE'VE SEEN
BETTER DAYS
ANOTHER
WORLD
TURF
TOE
BARNEY
FIFE
WAITING
ROOM
BELT
BUCKLE
WALK ON
WATER
AWAY IN
A MANGER
TRIPLE
CROWN
JOHNNY
APPLESEED
MADISON
AVENUE
IRON
CROSS
LIKE A FISH
OUT OF WATER
MURDER,
SHE WROTE
MUZZLE
VELOCITY
JULIA
CHILD
LOUISVILLE,

LOS ANGELES
DODGERS
LEONARD
NIMOY
KLONDIKE GOLD RUSH
NATIONAL HISTORICAL
PARK
LINCHPIN

IT STANDS
TO REASON
PAPER
ROSES
LIVE
BAIT
BABE
RUTH
WALLYWORLD

BEACHCOMBER

WE'RE
DOOMED
ARE YOU
LONESOME TONIGHT?
TULANE
GREEN WAVE
BARNEY
RUBBLE
VIVIAN,
LOUISIANA
BIG
MAC
WALK ON
EGGSHELLS
BABY YOU'RE
A RICH MAN
TRIGGER
PULL
JOHNNY
CARSON
MACKINAC ISLAND
STATE PARK
IRONING
BOARD
LIKE A BULL
IN A CHINA SHOP
MUTINY ON
THE BOUNTY
MUSICAL
STATUES
JULIE
ANDREWS
LOS ANGELES,

LONG
JUMP
LEVI
STRAUSS
KITTYHAWK,
NORTH CAROLINA

LIP
GLOSS
IT AIN'T OVER
'TILL IT'S OVER
PARADISE
LOST
LITTLE
LEAGUE
BABY FACE
NELSON
WALL,
SOUTH DAKOTA
BEDPAN

WAY
COOL
AROUND THE WORLD
IN 80 DAYS
TUG OF
WAR
BARRY
GOLDWATER
VIRGIN MOUNTAINS,
ARIZONA
BIKE
RENTAL
WAIT AND
SEE
BACHELOR
PARTY
TREE
STAND
JOSEPH
KENNEDY
LYNN,
MASSACHUSETTS
ITALIAN
TOMATO
LIGHTNING
IN A BOTTLE
MY FAIR
LADY
MUSICAL
CHAIRS
JULIE
CHRISTIE
LOS ALAMOS

LONG
COUNT
LEWIS &
CLARK
KINGSTON,
RHODE ISLAND

LITTLE
KINGS
IS THERE A DOCTOR
IN THE HOUSE?
PARTY
DOLL
LINEBACKER

BABY
HUEY
WALL
STREET
BEEF
SHORT RIBS
WATER UNDER
THE BRIDGE
ATTACK OF THE
KILLER TOMATOES
TRYOUT

BART
STARR
VINCENT,
ALABAMA
BIKINI
LINE
VARIETY IS THE
SPICE OF LIFE
BACK TO THE
FUTURE
TRAP
SHOOT
JOSEPH
STALIN
LUMBER
YARD
ITCHING
POWDER
LIGHT AS A
FEATHER
MY FAVORITE
MARTIAN
MUSHBALL

JULIET
MILL
LORAIN,

LOG
ROLLING
LINDA
BLAIR
KINGS CANYON
NATIONAL PARK

LIVERSAUSAGE

INNOCENT UNTIL
PROVEN GUILTY
PASSAGE TO
ADVENTURE
LINE
SCORE
BANK
TELLER
WALK-IN
CLOSET
BEER
BATTER
WAR IS
HELL
AUNTI
MAME
TRIPLE
SWIVEL
BASKET
WEAVER
VIKING LAKE
STATE PARK
BILL OF
RIGHTS
VALENTINE'S
DAY
BAD TO
THE BONE
TRACK
MEET
JUAN
PIZARRO
LUMBER TOWN,
U.S.A.
JACK-IN-THE-BOX

LIFE IS WHAT
YOU MAKE IT
MY FRIEND
FLICKA
MOUSETRAP

JULIET
PROWSE
LOOKOUT

TEN MINUTE
TICKER
LINDA
EVANS
KIMBERLY,
IDAHO

LOBSTER
POT
INDEPENDENCE
DAY
PATHS OF
GLORY
LIFT
TICKET
BARBARA
EDEN
WALKER,
MINNESOTA
BELLYBUTTON

WANTED, DEAD
OR ALIVE
AUTUMN
LEAVES
TRIPLE
PLAY
BAT
MASTERSON
VIENNA,
AUSTRIA
BING
CHERRIES
UPSET THE
APPLE CART
BALL OF
CONFUSION
TRACK AND
FIELD
JUDY
GARLAND
LOVELAND,
COLORADO
JAILBIRD

LIE LIKE
A RUG
MY FUNNY
VALENTINE
MOUNTAIN
CLIMBER
JULIUS
CEASAR
LONGWOOD

-continued

KENTUCKY
JAWBREAKER

LICK YOUR
CHOPS
MY LITTLE
MARGIE
MOTO
CROSS
NELSON
ROCKEFELLER
GLACIER NATIONAL
PARK
PICKAX

FLATTERY WILL GET
YOU EVERYWHERE
STAR
WARS
GROUND RULE
DOUBLE
NORMAN
LEAR
GATLINBURG,
TENNESSEE
PILLBOX

FIRST COME,
FIRST SERVED
SUDDEN
INMPACT
GOLF
CART
SANDY
DUNCAN
CONTACT,
NEVADA
SIDEBURNS

BY THE
BOOK
THE NIGHT
STALKER
CROSS-TRAINING

SEAN
PENN
COLDWATER,
MICHIGAN
SLOE GIN
FIZZ
BURY THE
HATCHET
THE OUTLAW

CALIFORNIA
JET
ENGINE
LET THEM
EAT CAKE
NANOOK OF
THE NORTH
MOTHER
MAY I?
NEWSCASTER

GILLETTE,
WYOMING
PICNIC
BASKET
FLAT AS A
PANCAKE
STATE
FAIR
GREYHOUND
RACING
NORMAN
ROCKWELL
GAS
STATION
PINBALL
MACHINE
FINISH WHAT
YOU START
SUDDENLY,
LAST SUMMER
GOLDEN STATE
WARRIORS
SANTA
CLAUS
CONRAD,
MONTANA
SILVER
LINING
BY
GEORGE
THE ODD
COUPLE
CROSS COUNTRY
SKIING
SECRETARY
OF STATE
COBLY,
KANSAS
SLUMBER
PARTY
BURNING THE CANDLE
AT BOTH ENDS
THE OWL AND

SCIENTIFIC MUSEUM
JEWELRY
BOX
LET THE CAT
OUT OF THE BAG
NATIONAL
GEOGRAPHIC
MOST VALUABLE
PLAYER
NICK
NOLTE
GHOST TOWN,
IDAHO
PICTURE
FRAME
FLAT AS
A BOARD
STEEL
MAGNOLIAS
GREEN BAY
PACKERS
OLD
MAN
GARY,
INDIANA
PINEAPPLE
UPSIDE-DOWN CAKE
FINGER LICKIN'
GOOD
SUGAR
MOUNTAIN
GOLD
MEDAL
SCARLETT
O'HARA
CONEY
ISLAND
SINGING
TELEGRAM
BUTTON
YOUR LIP
THE ONCE AND
FUTURE KING
CROSS
CHECKING
SERGEANT
AT ARMS
COCOA BEACH,
FLORIDA
SMOKE
DETECTOR
BURNED
OUT
THE PHANTOM OF

OHIO
JOCKSTRAP

LET SLEEPING
DOGS LIE
NATIONAL LAMPOON'S
ANIMAL HOUSE
MORNING
LINE
NOAH
BEERY
GETTYSBURG,
PENNSYLVANIA
PIE
CRUST
FIT FOR
A KING
STEEL
WHEELS
GREEN BAY PACKER
HALL OF FAME
OLIVE
OIL
GARNER,
IOWA
PIPE
DREAM
FINE-TUNED

SUNDAY BLOODY
SUNDAY
GOLD
GLOVE
SCOOBIE
DOO
CONCERT
HALL
SIT-DOWN
STRIKE
BUTTERFINGER

THE ONION
FIELD
CRIBBAGE
BOARD
SHEENA
EASTON
COAL
MINE
SNAKE
VENOM
BUG IN
A RUG
THE PIRATES OF

MOUNTAIN
JOY
STICK
LET IT
RIDE
NEVER SAY
NEVER AGAIN
MONTREAL
EXPOS
NOEL
COWARD
GEORGETOWN,
CONNECTICUT
PIERCED
EARS
FIT AS A
FIDDLE
STEPHEN KING'S
SILVER BULLET
GRAND
SLAM
OLIVER
NORTH
GARDEN OF EDEN,
KANSAS
PISTACHIO
PUDDING
FINE AS
SILK
SUNRISE,
SUNSET
GOAL LINE
STAND
SCOTT
JOPLIN
CONCENTRATION
CAMP
SLEEPING
BAG
BUSY AS
A BEE
THE OTHER SIDE
OF MIDNIGHT
CRAZY
EIGHTS
SHELLY
LONG
CLOTHES
STORE
SNOWFLAKE

BUCKLE
UP
THE PIT AND

GARDENS
JUICE
GLASS
LEAVE NO
STONE UNTURNED
NEWSWEEK

MONTREAL
CANADIENS
NOLAN
RYAN
GEARY,
OKLAHOMA
PIGS IN
A BLANKET
FISH
ON
STRANGERS ON
A TRAIN
GORDON
JOHNCOCK
OLIVIA
NEWTON-JOHN
GARBAGE
DUMP
PITCHFORK

FINE AND
DANDY
SURFIN'
U.S.A.
GO
FISH
SEAN
CONNERY
COMANCHE NATIONAL
GRASSLAND
SLIDE
TROMBONE
BUSINESS BEFORE
PLEASURE
THE OUTER
LIMITS
CRASH
HELMET
SHERIFF OF
NOTTINGHAM
CLEVELAND MUSEUM
OF ART
SOAP-ON-A-ROPE

BUCKLE
DOWN
THE POSEIDON

-continued

JOSEY WALES
CRANK
BAIT
ROGERS &
HAMMERSTEIN
CUSTER BATTLEFIELD
NATIONAL MONUMENT
SEAT
BELT
CLEANED
YOUR CLOCK
THE LAST
DETAIL
DIAMOND
VISION
ROSANNE
BARR
CRIPPLE CREEK,
COLORADO

SHARK
FIN
CHEW THE
FAT
THE LOVE
BOAT
DEGREE OF
DIFFICULTY
RICOCHET
RABBIT
DINOSAUR
NATIONAL MONUMENT
ROSEBUD

DEAD MEN
TELL NO TALES

THE GOLDEN
GIRLS
DUNGEONS AND
DRAGONS
ROBERT
REED
DEPARTMENT
STORE
SALT AND PEPPER
SHAKERS
DAMN THE
TORPEDOES
THE GUNS OF
NAVARONE
DROP
SHOT
DONALD

THE PUSSYCAT
COUNT THEM
OUT
ROMEO &
JULIET
CURTIS,
NEBRASKA
SECOND
HAND
CLEAN AS
A WHISTLE
THE LAST
PICTURE SHOW
DETROIT
LIONS
ROSEMARY
CLOONEY
CRIME
LAB

SHAVING
CREAM
CHATTERBOX

THE LOVE
BUG
DEEP CYCLE
BATTERY
RINGO
STARR
DICKENSON,
NORTH DAKOTA
ROUND
STEAK
DAY OF
RECKONING

THE GONG
SHOW
DUKE BLUE
DEVILS
ROBERT
YOUNG
DELTA NATIONAL
WILDLIFE REFUGE
SAND
CASTLE
CUTS LIKE
A KNIFE
THE GYPSY
MOTHS
DRIVING
RANGE
DONNA

THE OPERA
CORN
SNOW
RON
HOWARD
CRYSTAL
MOUNTAIN
SEED
CORN
CITY BY
THE BAY
THE LITTLE
DRUMMER BOY
DESIGNATED
HITTER
ROSIE
GRIER
CRESCENT BEACH
PARK, FLORIDA

SHEETMETAL

CHARITY BEGINS
AT HOME
THE MAGNIFICENT
SEVEN
DECKHAND

ROB
LOWE
DICKENS,
TEXAS
ROWBOAT

DARKER THAN
NIGHT

THE GOOD, THE BAD
AND THE UGLY
DUECES
WILD
ROBERTA
FLACK
DELAWARE
RIVER
SATELLITE
DISH
CUT TO THE
QUICK
THE HEADLESS
HORSEMAN
DRAW
POKER
DONNA

PENZANCE
CONTRACT
BRIDGE
RONALD
MCDONALD
CROSSROADS
VILLAGE
SELF-TORTURE

CHRISTMAS
EVE
THE LONGEST
YARD
DEPAUL
BLUE DEMONS
ROWAN &
MARTIN
CRATER LAKE
STATE NATIONAL
PARK
SHELL
GAME
CHARGE
IT
THE MAIN
EVENT
DEAD
HEAT
ROBERT
BLAKE
DIAMOND
MINE
RUBBER
HOSE
DARE TO
DREAM

THE GOODBYE
GIRL
DUCK
CALL
ROBERTO
CLEMENTE
DEEP CREEK
LAKE
SATINWOOD

CRYSTAL
CLEAR
THE
HONEYMOONERS
DRAG
BUNT
DORIS

THE PENDULUM
CONSERVATION
OFFICER
RONALD
REAGAN
CROSBY
GARDENS
SELLING
RACE
CHIP
IN
THE LORDS OF
FLATBUSH
DENVER
BRONCOS
ROWDY RODDY
PIPER
COW TOWN,
KANSAS

SHETLAND
WOOL
CHALK ONE
UP
THE MALTESE
FALCON
DAYTONA
500
ROBERT E.
LEE
DEVILS POST PILE
NATIONAL MONUMENT
RUBBERMAID
DISHES
DARE TO BE
DIFFERENT

THE GRAPES
OF WRATH
DUCK
BLIND
ROBERTO
DURAN
DEATH VALLY
NATIONAL MONUMENT
SAWHORSE

CREAM
PUFF
THE HOUND OF
THE BASTERVILLES
DOWNHILL
SKIS
DOUG

ADVENTURE
COMPOUND
BOW
ROOSTER
COGBURN
CROOKED RAPIDS,
ONTARIO
SEWING
MACHINE
CHIN UP
CHEST OUT
THE LOST
WEEKEND
DELAY OF
GAME
RUDOLPH THE RED
NOSED REINDEER
COURT
HOUSE

SHIPWRECK

CENTER
STAGE
THE MAN FROM
U.N.C.L.E.
DAVIS
CUP
ROBERT
PALMER
DESERT INN HOTEL &
CASINO
RUM AND
COKE
DAMNED IF YOU
DO AND DAMNED IF
YOU DON'T
THE GREAT
ESCAPE
DRY
FLY
ROBIN
HOOD
DEAD
SEA
SCALETAIL

COYOTE
UGLY
THE HOUSE OF
THE SEVEN GABLES
DOWN
RIGGER
DR.

-continued

SUTHERLAND
SANDPOINT,
IDAHO
DEAD
END
SPRING
FEVER
FRIDAY THE
13TH
SKY
DIVER
DR. RICHARD
KIMBLE
SAN ANTONIO,
TEXAS
DESK
CALENDAR
SPARE THE ROD,
SPOIL THE CHILD

FULL MOON
FEVER
SIT THE
BENCH

RICE
SANBORN,
IOWA
DECLARATION OF
INDEPENDENCE
SPRING
CLEANING
FRIGHT
NIGHT
SKIN
DIVING
DR. WHO

SAM HOUSTON
STATE PARK
DESSERT
CART
SOUR
GRAPES

FUNNY
FACE
SIMON
SEZ

SUMMER
SAN QUENTIN,
CALIFORNIA
DEEP-SEA
FISHING
SPOON-FED

FROM HERE
TO ETERNITY
SKI
LIFT
DUDLEY
MOORE
SALT LAKE CITY,
UTAH
DEVIL'S-FOOD
CAKE
SOUND THE
ALARM

FUTUREWORLD

SILVER
MEDAL

DAY
SAN JOSE,
CALIFORNIA
DELI
COUNTER
SPITTING
IMAGE
FROM RUSSIA
WITH LOVE
SKI
JUMP
DUKE OF
EARL
SALMON RIVER
CANYON
DEVILED
EGG
SOMETIMES NOTHIN'
CAN BE A REAL
COOL HAND
GARFIELD
GOOSE
SIDESTEP

HENNING
SAN FRANCISCO,
CALIFORNIA
DENTAL
FLOSS
SPECIAL
DELIVERY
FRUGAL
GOURMET
SKEET
RANGE
DUSTIN
HOFFMAN
SAKS FIFTH
AVENUE
DEWDROP

SOFT-BOILED

GENERAL
HOSPITAL
SIDE
HORSE

FRANKENSTEIN
SAN DIEGO
ZOO
DEODORANT
SOAP
SPEAK OF
THE DEVIL
FULL METAL
JACKET
SKATEBOARD

REDD
FOXX
DUTCH
VILLAGE
RIGHT
ANGLE
DON'T BE
RIDICULOUS

THE FALCON
AND THE SNOWMAN
ESKIMO
ROLL

BURT
REYNOLDS
THE DRAKE
HOTEL
CASSETTE
DECK
THE SPEED
OF LIGHT
CHAIN
GANG
TEE
AREA
CALVIN
KLEIN
TEACHER'S
LOUNGE
CEILING
FAN
THE SANDS
OF TIME
CHILDREN OF
THE CORN
TAPERED
LINE
BORN
LOSER
TOMS RIVER,
NEW JERSEY
BUSHLAND

THUMBS
UP
BRICK
HOUSE
THE ORANGE
BOWL
BRUCE
LEE
THE WASHINGTON
MONUMENT
CALCULATOR
WATCH
THIRD TIME'S
THE CHARM
BURNING
LOVE
THE FOUR
HORSEMEN
LORNE
GREENE
JORDAN,
MINNESOTA
MAD
MONEY

BUS
DRIVER
THE BELL OF
LOUISVILLE
CATCHWORD

THE SKY'S
THE LIMIT
CHANCES
ARE
TECHNICAL
KNOCKOUT
CAPTAIN
AMERICA
TAYLOR,
ALASKA
CELERY
STICK
THE RIGHT
STUFF
CHINA
BEACH
TANK
BATTLE
BOZO THE
CLOWN
TOM MIX
MUSEUM
BUSINESS
CARD
THROW IN
THE TOWEL
BRIDGET LOVES
BERNIE
THE
MEADOWLANDS
BRUCE
WAYNE
THE TOMB OF THE
UNKNOWN SOLDIER
CAMERA
TRIPOD
THIN-SKINNED

BUTTERFLIES ARE
FREE
THE FLORIDA
CITRUS BOWL
LOU
CHRISTIE
JOPLIN,
MISSOURI
MAGAZINE
RACK

BUSTER
KEATON
TEXAS
PANHANDLE
CATFOOD

THE SIMPLE
LIFE
CHARIOTS
OF FIRE
TECHNICAL
FOUL
CAPTAIN
CRUNCH
TARPON SPRINGS,
FLORIDA
CELLOPHANE
WRAP
THE PEN IS MIGHTIER
THAN THE SWORD
CHRISTMAS IN
CONNECTICUT
TANDEM
RACE
BRIAN
FERRY
TIMES SQUARE,
NEW YORK
BUTTERNUT
SQUASH
THROW CAUTION
TO THE WIND
BRINGING UP
BABY
THE LOUISIANA
SUPER DOME
BRUCE
WILLIS
THE SWISS
ALPS
CAMPBELL'S
SOUP
THIN AS
A RAIL
BYE BYE
BLACKBIRD
THE FINAL
FOUR
LOU
GOSSETT JR.
JOHN'S HOPKINS
CENTER
MAGIC
LANTERN

BUTCH
CASSIDY
TERMINAL
STATION
CATHODE
RAY TUBE
THE SHOW ME
STATE
CHARLIE'S
ANGELS
TEAMWORK

CAPTAIN
KANGAROO
TAMPA,
FLORIDA
CEMETARY
PLOT
THE PACK
IS BACK
CINNAMON
GIRL
TAMPA BAY
BUCCANEERS
BRICKLAYER

THREE RIVER FALLS,
MINNESOTA
BUTTERSCOTCH
BROWNIES
THREE SQUARES
A DAY
BROADCAST
NEWS
THE JOKER'S
WILD
BUCK
HENRY
THE SEARS
TOWER
CAMPFIRE

THICK AS
PEA SOUP
CADDYSHACK

THE FIESTA
BOWL
LOU
REED
JOHN HANCOCK
CENTER
MAGIC
WAND

BUZZ
ALDRIN
TEN SLEEP,
WYOMING
CATTLE
PROD
THE SHOT HEARD
'ROUND THE WORLD
CHICO AND
THE MAN
TARGET
PRACTICE
CARL
SAGAN
SYLVESTER,
GEORGIA
CENTERFOLD

THE MORE THE
MERRIER
CITIZEN
KANE
TAKEDOWN

BROADWAY
JOE NAMATH
THOMAS,
OKLAHOMA
CABIN
CRUISER
THREE ON A
MATCH
BROKEN
LANCE
THE INDIANAPOLIS
HOOSIER DOME
BUCK
ROGERS
THE SALT
FLATS
CAN
OPENER
THERE'S NO PLACE
LIKE HOME
CAGNEY &
LACEY
THE COTTON
BOWL
LUCILLE
BALL
JEWELRY
STORE
MAILBOX

CALAMITY
JANE
TEDDY ROOSEVELT
NATIONAL PARK
CEDAR
CHEST
THE SHORT END
OF THE STICK
CHILDREN OF A
LESSER GOD
TARGET
ARROW
CARLTON
FISK
SYDNEY OPERA
HOUSE
CHAIN
GANG
THE MIND'S
EYE
CLASH OF
THE TITANS
TAKE YOUR
MARKS
BROTHERS
GRIMM
THE
WHITE HOUSE
CABLE
BOX
THREE FINGERS
TALL
BULL
DURHAM
THE HOUSTON
ASTRODOME
BUCKWHEAT

THE SAHARA
DESERT
CANDLESTICK

THERE'S MORE HERE
THAN MEETS THE EYE
CALENDAR
GIRL
THE ALL-STAR
GAME
LUDWIG
VAN BEETHOVEN
JEWEL CAVE
NATIONAL MONUMENT
MANGROVE
SNAPPER

I SHALL
RETURN
PLANET OF
THE APES
LAWN
DARTS
LUKE
SKYWALKER
JEROME,
ARIZONA
MAPLE
SYRUP
HOTTER THAN A
DEPOT STOVE
PRINCE
OF THE CITY
KITE
FLYING
BIGFOOT

UNDERGROUND
GARAGE
BONED & BUTTERED
LAKE PERCH
TWO SHIPS THAT
PASS IN THE NIGHT
BEETLEJUICE

TIP-OFF

BING
CROSBY
TUNNEL OF
LOVE

BOW
TIE
TOTO, WE'RE NOT IN
KANSAS ANYMORE
BIRDMAN OF
ALCATRAZ
THROW IN
THE TOWEL
HOLLY
HUNTER
OIL CITY,
PENNSYLVANIA
FROZEN
FOOD
OUT OF SIGHT
OUT OF MIND
JOURNEY TO THE CEN-
TER OF THE EARTH
POTATO

I OWE
YOU ONE
PLEASE DON'T
EAT THE DAISIES
LAWN
BOWLING
MA
BARKER
JAMESTOWN,
RHODE ISLAND
MASKING
TAPE
HOPE
SPRINGS ETERNAL
PROM
NIGHT
KIDNEY
PUNCH
BILL
COSBY
ULYSSES,
KANSAS
BOOKEND

TWO OF
A KIND
BEHIND CLOSED
DOORS
TIME
TRIAL
BLAKE
EDWARDS
TRUTH OR
CONSEQUENCES, NEW
MEXICO
BOXCAR

TORN
DOWN
BLACK
BEAUTY
THREE RIVERS
STADIUM
HOPALONG
CASSIDY
OHIO
RIVER
FRUIT
PUNCH
OUT OF
ORDER
JUKE BOX
HERO
POT

I GOT
RHYTHM
POLICE
ACADEMY
LATERAL
WATER HAZARD
MACHINE GUN
KELLY
JACKSON
ZOO
MASON
JAR
HONESTY IS THE
BEST POLICY
PROUD
MARY
KICKBOARD

BILL
MURRAY
U.S. NAVAL
ACADEMY
BOOSTER
SEAT
TWO HEADS ARE
BETTER THAN ONE
BIG BAD
JOHN
TIME
ALLOWANCE
BLOOD, SWEAT &
TEARS
TRUNK
BAY

BOY SCOUT
JAMBOREE
TOP
DOG
BLACK SHEEP
SQUADRON
THREE OF
A KIND
HOWARD
COSELL
OFFICE
COMPLEX
FRUITCAKE

OTHER FISH IN
THE SEA
JUMPIN' JACK
FLASH
POSTMAN'S

-continued

I CAN'T PUT
MY FINGER ON IT
POP GOES
THE WEASEL
LADIES
DAY
MADELINE
KAHN
ISLE ROYALE
NATIONAL PARK
MASTERPIECE

HOME,
SWEET HOME
PUFF
THE MAGIC DRAGON
KICK
START
BILLY
CRYSTAL
U.S. MINT,
DENVER
BOOTSTRAP

TWO CAN PLAY AT
THAT GAME
BIG GIRLS
DON'T CRY
TIGHTWIRE

BLUEBEARD

TRUMP
PLAZA

BRANDING
IRON
TOO YOUNG
TO DIE
BLACKBOARD
JUNGLE
THOROUGHBRED
RACING
HOWARD
HUGHES
OFF
BROADWAY
FUEL
PUMP
OPPORTUNITY
KNOCKS
JUST BETWEEN
FRIENDS
POST

HUNGRY
AS A WOLF
POP
SINGER
KNOCKDOWN

MAGIC
JOHNSON
ISABEL,
SOUTH DAKOTA
MECHANICAL
PENCIL
HOLD
YOUR HORSES
PUPPY
LOVE
KENTUCKY
DERBY
BILLY
JOEL
TWELVE
MOUNTAINS
BOSTON
CREAM PIE
TRUTH IS STRANGER
THAN FICTION
BILLION DOLLAR
BABIES
TIE GOES TO
THE RUNNER
BO
DIDDLEY
TROY STATE
UNIVERSITY

BREADBOX

TOO MUCH OF
A GOOD THING
BLADE
RUNNER
THOMAS
FLAIR
HUBERT
HUMPHREY
O'HARE INTER-
NATIONAL AIRPORT
FULL-LENGTH
MIRROR
OPEN
SESAME
KANSAS CITY
BOMBER
POST

HOW NOW,
BROWN COW
POWER
OF GOLD
KNEE
BRACE
MAID
MARION
IRWIN,
IDAHO
MEDAL
OF HONOR
HOKEY SMOKES,
BULLWINKLE
PURPLE ROSE
OF CAIRO
KENO
RUNNER
BILLY
MARTIN
TURNER,
MAINE
BOTTLED
WATER
TRUE-BLUE

BILLY
JACK
TIC-TAC-TOE

BO
SCHEMBECHLER
TREE
HOUSE

BREASTPLATE

TOO MANY CHIEFS AND
NOT ENOUGH INDIANS
BLAZING
SADDLES
THIRD
BASE
HUCKLEBERRY
HOUND
NORTON,
KANSAS
FUNNY
BONE
ONLY YOU CAN
PREVENT FOREST FIRES
KATE &
ALLIE
PORTLAND

-continued

RACE
HUGH
DOWNS
NORTHERN
IRELAND
FURNACE
FILTER
ONLY THE GOOD
DIE YOUNG
KELLY'S
HEROES
PORT
TACK
CHAIRMAN
OF THE BOARD
STRATFORD-ON-AVON

CHARM
BRACELET
THE JOKE'S
ON YOU
COOL
MILLION
SWORDSMAN

CHEVY
CHASE
STERLING,
COLORADO
CHILI
DOG
THE GOOD
OLD DAYS
CRY ME
A RIVER
SURFACE
LURE
GEORGE
BUSH
PINE BLUFF,
ARKANSAS
FAKE
FUR
QUIT WHILE
YOU'RE AHEAD
I AM
THE WALRUS
ROLL
CAGE
GINGER
ROGERS
PHANTOM RANCH,
ARIZONA
FEATHER

BUNKER
HULK
HOGAN
NORTH CASCADES
HIGHWAY
FUZZY
DICE
ONE MORE
TIME
KING
KONG
POP-A-SHOT

CHARLES
SCHULTZ
STRAIT OF
GIBRALTAR
CHECKOUT
COUNTER
THE HONEYMOON'S
OVER
COME ON
DANGER
SWITCH-HITTER

CHICAGO SYM-
PHONY ORCHESTRA
STEAMBOAT SPRINGS,
COLORADO
CHIMNEY
PIECE
THE GOLDEN
RULE
DADDY'S
LITTLE GIRL
SUPER
STOCK
YOGI BEAR &
BOO BOO
PILGRIM
GLASS
FALSE
BOTTOM
QUIET AS
A MOUSE
I AM
WOMAN
RODEO
CLOWN
GIRL
FRIDAY
PETRIFIED FOREST
NATIONAL PARK
FENCE

KNOCK
HUMPHREY
BOGART
NORRIS
DAM
GARAGE DOOR
OPENER
ONE IN
A MILLION
KING OF
THE ROAD
POOL
RACK
CHARLIE
BROWN
STOUFFERS
HOTELS
CHEESEPUFF

THE HOME OF
THE BRAVE
CREATURE FROM THE
BLACK LAGOON
SWEATBAND

CHIEF EXECUTIVE
OFFICER
STATUE OF
LIBERTY
CHINA
DOLL
THE GARDEN
STATE
DANNY
BOY
SUNDAY
PUNCH
GEORGE
HARRISON
PIKES
PEAK
FAMILY
TREE
QUICK AS
A CAT
I DREAM
OF JEANNIE
ROD
AND REEL
GLEN
CAMPBELL
PERRY,
GEORGIA
FIBER

TIME
HUNTLEY &
BRINKLEY
NORMAN,
OKLAHOMA
GARBAGE
DUMPSTER
ONE FOOT IN
THE GRAVE
KISS OF THE
SPIDER WOMAN
POOL
CUE
CHARLIE
CHAPLIN
STORAGE
SHED
CHEF'S
SALAD
THE HANDWRITING'S
ON THE WALL
CREEPSHOW

SWAN
DIVE
CHILLY
WILLIE
STATEN
ISLAND
CHOCOLATE CHIP
COOKIES
THE FRUITS OF
ONE'S LABOR
DARK SIDE OF
THE MOON
SUMO
WRESTLER
GEORGE
WASHINGTON
PIDGEON FORGE
POTTERY
FANFARE

PUT YOUR
FOOT IN YOUR MOUTH
I FEEL
PRETTY
ROCK, PAPER,
SCISSORS
GLENDA THE GOOD
WITCH OF THE NORTH
PEORIA,
ILLINOIS
FIDDLER

POSITION
IKE & TINA
TURNER
NIXON,
NEVADA
GARDEN
HOSE
ONE AND
ONLY
KISSES SWEETER
THAN WINE
POLOPONY

CARLTON
HESTON
STONE MILL
WINERY
CHERRY
PICKER
THE GREATEST SHOW
ON EARTH
CRIME AND
PUNISHMENT
SUSPENDED
GAME
CHIP-N-DALE

STAR CITY,
ARKANSAS
CHRISTMAS
CAROL
THE FROST IS
ON THE PUMPKIN
DARK
VICTORY
SUDDEN
DEATH
GHOSTBUSTERS

PICKENS,
MISSISSIPPI
FARMHAND

PUT UP YOUR
HANDS
I FOUGHT
THE LAW
ROADWORK

GLENN
CLOSE
PEONY AMUSEMENT
CENTER NORTH
FIELD

TRAILBLAZERS
INDIANA
JONES
NINE EAGLES
STATE PARK
GARLIC
PRESS
ONCE UPON
A TIME
L.A.
LAW
POLE
VAULT
CHET
ATKINS
STEVENSON,
ALABAMA
CHEWING
TOBACCO
THE GOOSE THAT
LAID THE GOLDEN EGG
CRIME
STORY
SURFBOARD

CHRIS
EVERT
STANLEY,
NORTH DAKOTA
CHURCHYARD

THE FATHER OF
HIS COUNTRY
DAWN OF THE
DEAD
SUBWAY
SERIES
GINGER
LYNN
PICCADILLY
CIRCUS
FAT
CAT
PUT AN END
TO IT
I GET A KICK
OUT OF YOU
RIVERFRONT
STADIUM
GLENN
MILLER
PEBBLE BEACH,
CALIFORNIA
FIG

-continued

BED
PUSHING UP
THE DAISIES
I GOT THE SUN
IN THE MORNING
RIP
CORD
SIR LAURENCE
OLIVIER
CHESTER,
MONTANA
SOUTHERN
LIGHTS
BOTTOMS
UP

THE RUNNING
MAN
CLEARING
THE PUCK
SONNY &
CHER
CENTRAL
AMERICA
SPEED
TRAP
BOILED IN
OIL
THE SHAGY
DOG
CHURCHILL
DOWNS
FOGHORN
LEGHORN
PUMPHOUSE
STATION
ELECTRONIC
KEYBOARD
RUN LIKE
THE WIND
HEY
JUDE
SADDLEBAG

FRANK
NITTY
PRAIRIE ROSE
STATE PARK
ENGAGEMENT
RING
ROLL IN
THE HAY
HIT ME WITH
YOUR BEST SHOT

POST
PURR LIKE
A KITTEN
I HEARD IT THROUGH
THE GRAPEVINE
RINGTOSS

SITTING
BULL
CHESAPEAKE BAY
MARITIME MUSEUM
SPACE
HEATER
BOTTOM
OUT

THE SEA
WOLVES
CLEAN AND
JERK
SONNY
LISTON
CEDAR POINT,
KANSAS
SPEEDSTICK

BLOW HOT
AND COLD
THE SHAKIEST GUN
IN THE WEST
CHIP
SHOT
FORREST
TUCKER
PRISON
YARD
ELEPHANT'S-EAR

RUBBING
ELBOWS
HIGH
HOPES
SACRIFICE
FLY
FRANKLEN D.
ROOSEVELT
POWDER RIVER,
WYOMING
ENGLISH
MUFFIN
ROCK-N-ROLL

HITCHHICKER'S GUIDE
TO THE GALAXAY

OPTICS
PURE AS THE DRIVEN
SNOW
I JUST WANT
TO CELEBRATE
RING-NECK
PHEASANT
SLIM
PICKENS
CHARLTON CITY,
MASSACHUSETTS
SPAGHETTI AND
MEATBALLS
BORN WITH A SILVER
SPOON IN YOUR
MOUTH
THE SECRET LIFE
OF WALTER MITTY
CLAY
PIGEON
SPEAKER OF
THE HOUSE
CEASER'S PALACE
HOTEL & CASINO
SPELLCHECKER

BLONDES HAVE
MORE FUN
THE SINGING
NUN
CHINESE
CHECKERS
FOSTER
BROOKS
PRINT
SHOP
ELEVATED
RAILWAY
RUB
SHOULDERS
HIGH
NOON
SACRIFICE
BUNT
FRED
FLINTSTONE
POTTER PARK &
ZOO
ENLISTED
MAN
RISE AND
SHINE
HOGAN'S
HEROES

CRAB
PUMPKINHEAD

I LEFT MY HEART
IN SAN FRANCISCO
RIM
FIRE
SMITH &
WESSON
CHARLES TOWN
TURF CLUB
SPANISH
ONION
BOOTLICKER

THE SERPENT AND
THE RAINBOW
CLAY
COURT
SPENCER
TRACY
CATHERINE,
ALABAMA
SPICE
RACK
BLOCKHEAD

THE SIX MILLION
DOLLAR MAN
CHICAGO
WHITE SOX
FRANCIS
SCOTT KEY
PRINCESS ANNE,
MARYLAND
ELKHOUND

ROUGH-AND-READY

HIGH PLAINS
DRIFTER
SACRAMENTO
KINGS
FRED
SANFORD
POSTVILLE,
IOWA
EQUAL
SIGN
RING YOUR
OWN BELL
HOMEWARD
BOUND

MOUSE
PULL THE WOOL
OVER MY EYES
I LOVE
LUCY
RIGHT
WING
SMOKEY
ROBINSON
CHAPEL HILL,
NORTH CAROLINA
SPARE
TIRE
BOOTLEGGED
LIQUOR

THE
SEVEN-UPS
CLAIMING
RACE
SPIDER
MAN
CATHEDRAL
STATE PARK
SPIDER'S
WEB
BLIND AS
A BAT
THE SONS OF
KATIE ELDER
CHICAGO
CUBS
FRANK
BUCK
PRICE,
UTAH
EMERY
BOARD
ROME WAS NOT
BUILT IN A DAY
HILL STREET
BLUES
SACK
RACE
FRAIR
TUCK
PORTLAND,
OREGON
EQUIPMENT
BAG
RIGHT OF
WAY
HONEYSUCKLE
ROSE

TREE
PROUD AS
A PEACOCK
I ONLY HAVE
EYES FOR YOU
RIGHT
FIELD
SNOW
WHITE
CHALK
PYRAMIDS
SPARK
PLUG
BOMB'S
AWAY

THE SEVENTH
SIGN
CINCINNATI
REDS
SPIKE
LEE
CASTLE ROCK,
COLORADO
SPONGE
BATH
BLAME
YOURSELF
THE SOUND OF
FURY
CHICAGO
BLACKHAWKS
FRANK
LLOYD WRIGHT
PREPARATION CANYON
STATE PARK
END
TABLE
ROLL OF
THE DICE
HIS GIRL
FRIDAY
RUSHING
YARDAGE
G. GORDON
LIDDY
PONY EXPRESS
STATION
EVENING
GOWN
REST IN
PEACE
HORSE
FEATHERS

-continued

RUNS
BATTED IN
DAVID &
GOLIATH
SHOE
STORE
CORN ON
THE COB
TAKE A
BACK SEAT
FAMILY
BUSINESS
SPELLING
BEE
DEBBIE
REYNOLDS
SEYMOUR,
CONNECTICUT
CRAWDAD

STUBBORN
AS A MULE
FEAR STRIKES
OUT
SOUTHWESTERN
CONFERENCE
ELTON
JOHN
ROAD
AMERICA
DRAWING
BOARD
SHOT AND
A BEER
GORILLAS IN
THE MIST
SEMI-AUTOMATIC

EYE
WITNESS
RESERVE,
NEW MEXICO
DRUMBEAT

SHAKEN,
NOT STIRRED
GUNFIGHT AT THE
O.K. CORRAL
SEA
WOLF
COLONEL
MUSTARD
SPARKS,
NEVADA

RUNNING
BACK
DAVID
CASSIDY
SHIP BOTTOM,
NEW JERSEY
COTTAGE
CHEESE
SWEET AS
SUGAR
FANTASTIC
VOYAGE
SPEED
SKATING
DENNIS
WEAVER
SEVEN SISTERS FALLS,
MANITOBA
CRAWL
SPACE
STRONG AS
AN OX
FIDDLER ON
THE ROOF
SOLDIER
FIELD
ELVIS
PRESLEY
RIVERFRONT
PARK
DRESSING
TABLE
SHOOTING
STAR
GREASED
LIGHTNING
SECOND-STRING

FARRAH
FAWCETT-MAJORS
RENO,
NEVADA
DRY
ICE
SHAKE LIKE
A LEAF
GUNSMOKE

SCUBA
DIVER
COLONEL
SANDERS
SPANISH FORK,
UTAH

RUB OF
THE GREEN
DAVID
LETTERMAN
SHEPHERD OF THE
HILLS FARM
COVER
LETTER
SUNNY SIDE
UP
FANTASY
ISLAND
SPEED
RATING
DENVER
PYLE
SEQUOIA
NATIONAL PARK
CREAM
CHEESE
STRIKE IT
RICH
FIELD OF
DREAMS
SOFTBALL

ERIC THE
RED
RIPLEY,
TENNESSEE
DRILL
PRESS
SHIPSHAPE

GREAT
PRETENDER
SECOND
BASE
FASHION
MODEL
REMINGTON,
INDIANA
DUFFLE
BAG
SEEING IS
BELIEVING
HAIR OF
THE DOG
SCREEN
PASS
COMEDY
WRITER
SOUTHERN
CALIFORNIA

ROYAL
FLUSH
DAVY
CROCKETT
SHELDON
ART GALLERY
COWBELL

SUGAR-FREE

FATAL
ATTRACTION
SPEED
BAG
DEPUTY
DOG
SENECA
GLASS COMPANY
CREAM OF MUSHROOM
SOUP
STRAIGHT-LACED

FIND YOUR
WAY BACK
SOCCER
BALL
ERNIE
BANKS
RICH HILL,
MISSOURI
DRIVE
SHAFT
SHIP OF
FOOLS
GREEN
ACRES
SEATTLE
SEAHAWKS
FAT
ALBERT
REDWOOD
NATIONAL FOREST
DUMBBELL

SEEING
DOUBLE
HAMBURGER
HILL
SCOREBOARD

COMPUTER
PROGRAMMER
SOUTH
WALES

ROWING
SHELL
DEAN
MARTIN
SHEDD
AQUARIUM
CRACKER
JACK
STUFFED
SHIRT
FATHER
OF THE BRIDE
SPEAR
GUN
DIANA
ROSS
SEATTLE,
WASHINGTON
CRESCENT
WRENCH
STRADDLE
THE FENCE
FIRESTARTER

SNOWSHOE

ERROL
FLYNN
REYNOLDS,
INDIANA
DROPCLOTH

SHARP AS
A TACK
GREEN EGGS
AND HAM
SEATTLE
MARINERS
FATHER
FLANAGAN
REDKEY,
INDIANA
DUMP
TRACK
SEE YOU LATER
ALLIGATOR
HANG 'EM
HIGH
SCORE
CARD
CONNIE
CHUNG
SOUP
KITCHEN

ROWING
MACHINE
DEAR
ABBY
SHAKER
MUSEUM
CRANKSHAFT

STUCK-UP

FEAR OF
FLYING
SPACE
INVADERS
DIANE
SAWYER
SEA OF
TRANQUILITY
CREW
CUT
STOP, LOOK
AND LISTEN
FIVE MINUTES
MORE
SNOWMOBILE

EVA MARIE
SAINT
RETIREMENT
HOME
DRUG
ADDICTION
SHAPE UP
OR SHIP OUT
GUEST WHO'S
COMING TO DINNER
SEASON
TICKETS
FATHER
TIME
REDHOUSE,
MARYLAND
DUNCAN
HINES
SEASICK

HAPPY
DAYS
SCHOOL
FIGURES
COOKIE
MONSTER
SOUND
SET

-continued

| | | | | | |
|---|---|---|---|---|---|
| CLIPBOARD | CLOAKROOM | CLOCK | CLOSE-UP | CLUB | CLUTCH |
| | | RADIO | LENS | SANDWICH | PLATE |
| THE BOTTOM | THE BIGGER THEY ARE | THE BIG | THE BIG | THE BEST THINGS | THE AYES |
| LINE | THE HARDER THEY | HOUSE | APPLE | IN LIFE ARE FREE | HAVE IT |
| | FALL | | | | |
| DOG DAY | DON'T FENCE | DON'T WORRY, | DR. JEKYLL | DR. NO | DR. |
| AFTERNOON | ME IN | BE HAPPY | AND MR. HYDE | | STRANGELOVE |
| STEPPING | STEP IN | STEEPLECHASE | STEAM | STARTING | STARTING |
| STONES | THE BUCKET | COURSE | ROOM | PITCHER | BLOCK |
| COURT | CREDENCE CLEAR- | CROCODILE | CROSBY, STILLS, | CURLY | CURTIS |
| CLERK | WATER REVIVAL | DUNDEE | NASH & YOUNG | HOWARD | STRANGE |
| SOMERS, | SODA SPRINGS, | SOCK | SOAP LAKE, | SNOWBIRD | SNAKE RIVER |
| MONTANA | IDAHO | DRAWER | WASHINGTON | MOUNTAINS | CANYON |
| COAL | COAT OF | COFFEE | COLD | COLEMAN | COLORING |
| SHOVEL | ARMS | CAN | CUTS | STOVE | BOOK |
| THE APPLE OF | THE ALMIGHTY | THAT'S THE | THAT'S ALL, | THAT'S ABOUT THE | THANK YOUR |
| HIS EYE | DOLLAR | TICKET | FOLKS | SIZE OF IT | LUCKY STARS |
| DREAM A LITTLE | DRESSED TO | DRIVE MY | DUCK | DUST IN | EASTER |
| DREAM OF ME | KILL | CAR | SOUP | THE WIND | PARADE |
| STARBOARD | STANDOFF | STANDING ROOM | STANDING | STAIR | ST. LOUIS |
| TACK | | ONLY | OVATION | MASTER | CARDINALS |
| RAQUEL | RAY | RAY | RAYMOND | RED | DWIGHT D. |
| WELCH | CHARLES | KROC | BURR | GRANGE | EISENHOWER |
| EDISON, | EDDYVILLE, | EAST CHICAGO, | EAST | EAGLE RIVER, | SAINTS |
| GEORGIA | KENTUCKY | INDIANA | BERLIN | WISCONSIN | AUDITORIUM |
| RED FLAME | REFRIED | REVOLUTIONS | REVOLVING | RIDING | DIAMONDBACK |
| GRAPES | BEANS | PER MINUTE | DOOR | MOWER | RATTLESNAKE |
| DON'T JUDGE A BOOK | DON'T GO TO | DON'T GIVE UP | DON'T COUNT YOUR | DON'T BURN YOUR | SOCK IT |
| BY ITS COVER | EXTREMES | THE SHIP | CHICKENS BEFORE | BRIDGES BEHIND YOU | TO ME |
| | | | THEY'RE HATCHED | | |
| THE DIVINE | THE DOBERMAN | THE ELEPHANT | THE EMPEROR'S | THE EMPIRE | GENTLEMEN |
| COMEDY | GANG | MAN | NEW CLOTHES | STRIKES BACK | PREFER BLONDES |
| FAIRWAY | FAIR | FACE | EXTRA | EVEN | SHUT THE |
| | CATCH | MASK | INNINGS | UP | BOX |
| E. F. | EARL "THE PEARL" | EARL | ED | EDDIE | EDDIE |
| HUTTON | MONROE | ANTHONY | NORTON | ALBERT | ARNOLD |
| RUSSELL CAVE | RUGBY, | RUBY, | ROYAL GORGE, | ROY, | ROUGH RIVER DAM |
| NATIONAL MONUMENT | NORTH DAKOTA | ALASKA | COLORADO | MONTANA | STATE RESORT PARK |
| DIAPER | DIGITAL | DILL | DINETTE | DISC | DISHRAG |
| BAG | SCALE | PICKLE | SET | BRAKE | |
| SOAR LIKE | SO HUNGRY I COULD | SNATCHED OUT OF | SMOKE LIKE | SLIPPERY | SLEEP WITH |
| AN EAGLE | EAT A HORSE | THE JAWS OF DEATH | A CHIMNEY | AS AN EEL | THE FISH |
| GEORGE OF | GET OFF OF | GET | GHOST | GILLIGAN'S | GIRLS JUST WANT TO |
| THE JUNGLE | MY CLOUD | SMART | STORY | ISLAND | HAVE FUN |
| SHUFFLEBOARD | SHOULDER | SHOTS ON | SHOTGUN | SHORTSTOP | SHORT |
| | PADS | GOAL | SHELLS | | COUNT |
| MARK | MARK | MARLA | MARLBORO | MARLIN | MARLON |
| SPITZ | TWAIN | MAPLES | MAN | PERKINS | BRANDO |
| HUGO, | HOUSTON, | HOUSE OF | HOT SPRINGS | HOSPITAL | HORTON, |
| OKLAHOMA | TEXAS | MIRRORS | NATIONAL PARK | WARD | KANSAS |
| MINUTE | MIX | MODEL 'A' | MOLEHILL | MONEY | MONKEY |
| HAND | MASTER | FORD | | CLIP | WRENCH |
| HEY IS | HERE'S MUD | HERE TODAY, | HELL IN A | HEDGE YOUR | HEARTBROKEN |
| FOR HORSES | IN YOUR EYE | GONE TOMORROW | HANDBASKET | BETS | |

-continued

RATTLE
AND HUM
IRONMAN
TRIATHLON
MARSHALL
FIELD
HORSEHEADS,
NEW YORK
MOONROOF

HEART OF
STONE
RED SAILS
IN THE SUNSET
INFIELD FLY
RULE
JACLYN
SMITH
NAVY
PIER
GINGER
ALE
NOTHING VENTURED,
NOTHING GAINED
LEATHER AND
LACE
PITCHING
WEDGE
JAMES
TAYLOR
MY OLD KENTUCKY
HOME STATE PARK
GRAB
BAG
NOSE IN
THE AIR
LET ME
BE THERE
PHOTO
FINISH
MEREDITH
BAXTER-BIRNEY
HILL & HOLLOWS
CRAFT SHOP
NAVEL
ORANGE
HAPPY
AS A CLAM
RUN FOR
YOUR LIFE
HOUSTON
ASTROS
MICHELANGELO

RAVE
ON
IRON
CROSS
MARTIN
LUTHER KING
HORSE SHOE BEND,
IDAHO
MOOSEHEAD

HEAR
BOTH SIDES
REVENGE
OF THE NERDS
INDIANAPOLIS
MOTOR SPEEDWAY
JACQUES
COUSTEAU
NATIONAL BOWLING
HALL OF FAME
GLASS
CUTTER
NOTHING IS
IMPOSSIBLE
LEAVE IT
TO BEAVER
PISTOL
RANGE
JAMES
WOODS
MUSTANG
RANCH
GRADUATING
CLASS
NO PAIN,
NO GAIN
LICENSED
TO KILL
PHOENIX
SUNS
MERLE
HAGGARD
HIGH BRIDGE,
NEW JERSEY
NAVY
BEAN
HANDS OF
STONE
RUN SILENT,
RUN DEEP
HOT
CORNER
MICKEY
MANTLE

REAL
PEOPLE
INTENTIONAL
WALK
MARTY
FELDMAN
HOOVER
DAM
MORNING
GLORY
HEAD
IN THE SAND
RIDE
CAPTAIN RIDE
INDIANA
PACERS
JAMES
BOND
McPHERSON,
KANSAS
GLOW
WORM
NOT WORTH
HIS SALT
LEGAL
EAGLES
PIN THE TAIL
ON THE DONKEY
JAMIE LEE
CURTIS
MUSIC MOUNTAIN,
ARIZONA
GRAIN
EMBARGO
NO MAN'S
LAND
LIGHTNIN'
STRIKES
PHOENIX
CARDINALS
METER
MAID
HICKORY,
NORTH CAROLINA
NECKTIE

HAND-ME-DOWNS

SATURDAY NIGHT
FEVER
HORSEHOES

MICKEY
ROONEY

REAR
WINDOW
INSTANT
LOTTO
MARVIN
GAYE
HOOSIER
NATIONAL FOREST
MORTARBOARD

HEAD AND SHOULD-
ERS ABOVE THE REST
RIN
TIN TIN
INBOARD/OUTBOARD
MOTOR
JAMES
DEAN
McCORMICK,
SOUTH CAROLINA
GOATSKIN

NOT FIT FOR
MAN NOR BEAST
LEGEND OF WOOLEY
SWAMP
PIGGYBACK
RACE
JANE
CURTIN
MUSEUM OF SCIENCE
AND INDUSTRY
GRAPE
JELLY
NO MAN IS
AN ISLAND
LIGHTS
OUT
PHILADELPHIA
PHILLIES
MICHAEL
DOUGLAS
HERSHEY PARK,
USA
NEON
LIGHT
HALF-BAKED

SAVE THE LAST
DANCE FOR ME
HORSE
RACE
MIGHTY
MOUSE

REBEL WITHOUT
A CAUSE
INSIDE THE PARK
HOME RUN
MARY &
JOSEPH
HOOKER,
OKLAHOMA
MOUNTAIN
GOAT
HE WHO LAUGHS LAST
LAUGHS BEST
RING
OF FIRE
IN THE
HOLE
WOODY
WOODPECKER
McARTHUR,
OHIO
GOLDEN
TAN
NOT BY
A LONG SHOT
LEMON
TREE
PIG
LATIN
JANE
FONDA
MUSCLE
BEACH
GRAGH
PAPER
NO ITS,
ANDS OR BUTS
LILIES OF
THE FIELD
PHILADELPHIA
EAGLES
MICHAEL
JACKSON
HERRELD,
SOUTH DAKOTA
NERVE
CENTER
GUILTY
AS SIN
SCHOOL
DAYS
HORIZONTAL
BAR
MIKE
HAMMER

RED
DAWN
INSIDE
RAIL
MARY
HART
HOOD
RIVER
MOUSETRAP

HE WHO HESITATES
IS LOST
RIPLEY'S
BELIEVE IT OR NOT
IMPROVE
YOUR LIE
JAMES
STEWART
MYRTLE
BEACH
GOOSEBERRY

NOSE TO THE
GRINDSTONE
LET IT
BE
PICK-UP
STICKS
JANE
RUSSELL
MURRAY,
KENTUCKY
GRAVESTONE

NO HITTING
BELOW THE BELT
LION SLEEPS
TONIGHT
PERFECT
GAME
MICHAEL
JORDAN
HENDERSON,
TENNESSEE
NEWSPAPER

GUESS
AGAIN
SEA OF
LOVE
HOPSCOTCH

MIKE
TYSON

HELPER,
UTAH
NIGHT
STAND
GRIN AND
BEAR IT

SEARCH FOR
TOMORROW
HOOK
SLIDE
JEFFERSON
DAVIS
MOOSE LAKE,
MINNESOTA
GUNPOWDER

MY EARS
ARE RINGING
LONELY
BOY
PASS
RUSH
JIM
BURT
MISSION OF ST.
FRANCIS OF ASSISI
HALTER
TOP
MONKEY
AROUND
LOVE ME
TENDER
OUT-OF-BOUNDS

THE PINK
PANTHER
BLUE LICKS
BATTLE FIELD
TIE
CLASP
AS EASY AS A HOT
KNIFE THRU BUTTER
TRILOGY OF
TERROR
BLACKJACK

THE UNKNOWN
SOLDIER
BISHOP HILL,
ILLINOIS
TOOLBELT

APPLE PIE

HEART OF
HILLS ROAD
NOAH'S
ARK
GREAT DAY
IN THE MORNING

SECRET
AGENT
HOME
RUN
JERRY LEE
LEWIS
MOORE,
IDAHO
GUM
SHOES
MY DOGS
ARE BARKIN'
LONG DAY'S JOURNEY
INTO NIGHT
PARALLEL
BAR
JIM
GAZDICK
MINUTE MAN NATION-
AL HISTORIC PARK
HAMHOCKS

MONEY IS THE
ROOT OF ALL EVIL
LOVE
SHACK
ORLANDO
MAGIC
THE RED
BARON
BLUE EARTH,
MINNESOTA
TIME
STUDY
AS DEEP AS
A WELL
TRUE
GRIT
BLACK
BELT
THE VILLAGE
IDIOT
BINGHAM,
MAINE
TOOTHBRUSH

AN EYE

HAZARD,
KENTUCKY
NORTHERN
BATHROOM TISSUE
GREASED
LIGHTNING

SEE NO
EVIL
HOME
PLATE
JESSE
JACKSON
MONROE,
GEORGIA
HACKSAW

MUM'S THE
WORD
LONG TALL
SALLY
PAN-AMERICAN
GAMES
JIM
PALMER
MINNEAPOLIS,
MINNESOTA
HANDRAIL

MISTER
RIGHT
LOVE,
AMERICAN STYLE
OPEN-FACED
REEL
THE SUNDANCE
KIDD
BLOCK ISLAND,
CONNECTICUT
TOASTER
OVEN
AS ALL
GET OUT
TURN THE
PAGE
BILLIARD
TABLE
THE WICKED WITCH
OF THE WEST
BIG TIMBER
MONTANA
TOPSOIL

AN EMPTY VESSEL

-continued

HAWAII VOLCANOES
NATIONAL PARK
NOSEPIECE

GOT YOUR
BELL RUNG

SEMI-TOUGH

HOLE IN
ONE
JESSE
JAMES
MOHAWK
MOUNTAIN SKI AREA
HAIRSPRAY

MOTORHEAD

LOOK WHO'S
TALKING
PAINT
GUN
JIMINY
CRICKET
MINING
CAMP
HARD
SALAMI
MISERY
LOVES COMPANY
LUCKY
LADY
OPEN
SEASON
THE TALKING
HEADS
BLACKFOOT INDIAN
RESERVATION
TOENAIL

ARM IN
ARM
TWELFTH
OF NEVER
BIG TEN
CHAMP
THE WIZARD
OF OZ
BIG STONE GAP,
VIRGINIA
TORTOISE
SHELL
AN ELEPHANT

HATCH,
NEW MEXICO
NOTEBOOK

GOT UP ON THE
WRONG SIDE OF THE
BED
SERGEANT
BILKO
HOCKEY
PUCK
JESSICA
HAHN
MISSOURI
RIVER
HALLEY'S
COMET
MOTHER'S
DAY
LORD OF
THE RINGS
PADDLE
BALL
JIMMY
CARTER
MINE
SHAFT
HARVEST
MOON
MILLION DOLLAR
IDEA
LUCY IN THE SKY
WITH DIAMONDS
ONE-HOPPER

THE TOOTH
FAIRY
BLACK ROCK
STATE PARK
TOILET
BOWL
ARBOR
DAY
TWELVE
ANGRY MEN
BIG GAME
HUNTER
THEODORE
ROOSEVELT
BIG HORN
CANYON
TOURIST
TRAP
AN AXE

HARVARD
UNIVERSITY
NUTCRACKER

GOOD-FOR-NOTHING

SESAME
STREET
HITTING
STREAK
JILL
ST. JOHN
MISSISSIPPI
RIVER
HALLWAY

MORE THAN
ENOUGH
LOST IN
SPACE
OUTRIGGER
CANOE
JIMMY
CLIFF
MILWAUKEE
COUNTY ZOO
HATBAND

MEMORIAL
DAY
MACK THE
KNIFE
ONE-EYED
JACKS
THE UNKNOWN
COMIC
BIXBY,
OKLAHOMA
TOMATO
PLANT
APRIL FOOL'S
DAY
TWILIGHT
TIME
BEST BALL
MATCH
THOMAS
DOLBY
BERLIN,
NEW HAMPSHIRE
TOWEL
RACK
AN APPLE A DAY

-continued

ORDER

TWO MULES FOR
SISTER SARA
BERMUDA
GRASS
STEWART
GRANGER
CARIBBEAN
SEA
STEEL
MILL
BIG AS
A HOUSE
THE THIN
MAN
CENTER-SHOT
BOW
SYBIL
DANNING
CANYON LANDS
NATIONAL PARK
STREET SIGN
BELLY-UP

THE TROUBLE
WITH HARRY
CAST OFF
WALTER
BRENNAN
ARTHUR,
NEVADA
WHITE
RUSSIAN
A PERFECT END
TO A PERFECT DAY
ZORBA
THE GREEK

ARKANSAS
RAZORBACKS
WAYNE
GRETZKY
APPALACHIAN
MOUNTAIN CLUB
WINE
COOLER
A GHOST
OF A CHANCE
WON'T GET
FOOLED AGAIN
AMATEUR
DRAFT
"SAY HEY"

FOR AN EYE

UNCLE TOM'S
CABIN
BENT
GRASS
STOCK CAR
DRIVER
CAREY,
IDAHO
STICK
SHIFT
BEYOND
BELIEF
THE
THORNBIRDS
CENTER
ICE
SYLVESTER
STALLONE
CANNON BALL,
NORTH DAKOTA
STRING BIKINI
BELLE OF
THE BALL
THE TWO
RONNIES
CART PATH
YUL
BRYNNER
ART INSTITUTE
OF CHICAGO
WIDE-ANGLE
LENS
A PENNY SAVED IS
A PENNY EARNED
WILD
THING

ARIZONA
WILDCATS
WAYNE
NEWTON
ANTHONY,
KANSAS
WING
FLAP
A GAME
OF INCHES
WORKING FOR
THE WEEKEND
AMATEUR
ATHLETIC UNION
"SUGAR RAY"

MAKES THE MOST
NOISE
UNDER THE
BOARDWALK
BELOW THE
BELT
SUGAR RAY
LEONARD
CARBONDALE,
ILLINOIS
STOP
SIGN
BETWEEN A ROCK
AND A HARD PLACE
THE THREE
STOOGES
CENTER
FIELD
TALK SHOW
HOST
CANFIELD
CASINO
STRIP MALL
BEGGARS CAN'T
BE CHOOSERS
THE TWO
TOWERS
CARD THROWING
WALTER
MATTHAU
ARCTIC
CIRCLE
WILD
RICE
A PENNY FOR
FOR YOUR THOUGHTS
WILLY WONKA AND
THE CHOCOLATE
FACTORY
ARABIAN
HORSE
WELLS
FARGO
ANTELOPE
PARK
WIRELESS
MICROPHONE
A FRIEND IN NEED
IS A FRIEND INDEED
WORKING
GIRLS
ALUMINUM
BAT
"TENNESSEE"

NEVER FORGETS

UNDER THE
YUM YUM TREE
BELL
SINKER
SUPERMAN

CAR
TRUNK
STORAGE
BIN
BETTER
HALF
THE TIME
MACHINE
CATCHER'S
MITT
TANYA
TUCKER
CANE,
PENNSYLVANIA
SUGAR CANE
BEET RED

THE UGLY
DUCKLING
CANOE TRIP
WALTER
PATON
ARCHES
NATIONAL PARK
WINDOWSILL

A MAN'S HOME
IS HIS CASTLE
WINNERS
TAKE ALL

ANKLE
RACE
WILBUR & ORVILLE
WRIGHT
ANN ARBOR,
MICHIGAN
WITCHCRAFT

A FORK
IN THE ROAD
WOULDN'T IT
BE NICE
ALSO-
RAN
ABBIE

TO GRIND

UP IN
SMOKE
BEETLE
SPIN
SUPERTRAMP

CAPITOL REEF
NATIONAL PARK
STRAIGHT
RAZOR
BET YOUR
BOTTOM DOLLAR
THE TIN
STAR
CAT AND
MOUSE
TARZAN THE
APEMAN
CAMP
DAVID
SUIT OF ARMOR
BEES IN
THE BONNET
THE UNHOLY
FOUR
CANDLESTICK PARK
WARREN
BEATTY
ARBOR
LODGE
WINDSHIELD
WIPER
A LITTLE FISH
IN A BIG POND
WITNESS FOR
THE PRESECUTION

AMERICAN FOOTBALL
CONFERENCE
WILD BILL
HICKCOK
ANHEUSER BUSCH
BREWERY, ST. LOUIS
WITNESS
STAND
A FOOT
IN THE DOOR
YELLOW
SUBMARINE
ALLOWANCE
RACE
ABRAHAM

KEEPS THE DOCTOR
AWAY
UPSTAIRS,
DOWNSTAIRS
BEER
FRAME
SUZANNE
SOMERS
CAPE CANAVERAL,
FLORIDA
STRAWBERRY
JAM
BEND BUT
DON'T BREAK
THE TOWERING
INFERNO
CASUAL
WATER
TAXI
DRIVER
CALHOUN,
GEORGIA
SUMMER HOME
BEAUTY IS
ONLY SKIN DEEP
THE WAR
WAGON
CANADA GOOSE
WARREN
BURGER
APPLE
VALLEY
WINDSOCK

A LEG TO
STAND ON
WOMAN FROM
TOKYO

AMERICA'S
CUP
WILE E.
COYOTE
ANACONDA
COPPER CO.
WOOD-BURNING
STOVE
A FOOL AND HIS MONEY
ARE SOON PARTED
YES SIR,
THAT'S MY BABY
ALL-
AMERICAN
ADAM

-continued

WILLIE MAYS
YUKON FLATS NA-
TIONAL MONUMENT
100,000
DOLLAR BAR
YOUTH IS WASTED
ON THE YOUNG
1001
RABBIT TALES
YELLOW
FLAG
ADMIRAL
BYRD
WORLD
TRADE CENTER
ADAM'S
APPLE
YOU'LL CATCH YOUR
DEATH OF A COLD
A DAY IN
THE LIFE
WINNING
STREAK
AMBER LYNN
WILBER,
NEBRASKA
ARCHWAY

WITHOUT RHYME
OR REASON
A WOMAN
OF PARIS
WATER
CAST
ANN-MARGRET

WESTMINSTER
ABBY
BABY
SWISS
WHITE AS
A GHOST
ALI BABA AND
THE FORTY THIEVES
VIDEO
GAMES
KATHY
SMITH
LIVING DESERT
STATE PARK
KITCHEN
SINK
LABOR
DAY

ROBINSON
YOUNGSTOWN,
OHIO
12-VOLT
BATTERY
YOUR GUESS IS
AS GOOD AS MINE
16
CANDLES
YANKEE
STADIUM
ADOLF
HITLER
WOONSOCKET,
RHODE ISLAND
ADDING
MACHINE
YOU TAKE THE
HIGH ROAD
A FACE IN
THE CROWD
WINNEPEG
JETS
AMOS-N-ANDY
WICHITA MOUNTAINS
WILDLIFE REFUGE
ARMREST

WINNING
UGLY
ABOUT
LAST NIGHT
WASHINGTON
HUSKIES
ANNETTE
FUNICELLO
WEST DENNIS,
MASSACHUSETTS
BABY'S
BREATH
WHISTLE WHILE
YOU WORK
ALICE IN
WONDERLAND
VAULTING
POLE
KEITH
BLACK
LIVERPOOL,
OHIO
KITTY
LITTER
KNUCKLE
UNDER

ERNIE FORD
YELLOWSTONE
NATIONAL PARK
ACADEMY
AWARD
YOUR DANCING DAYS
ARE OVER
2001: A SPACE
ODYSSEY
WRIGLEY
FIELD
ADOLPH
COORS
WOODSTOCK,
NEW YORK
AFRICAN
VIOLET
YOU ONLY
LIVE ONCE
A FAREWELL
TO ARMS
WING
SHOT
ANDREW JACKSON
WHITE HEN
PANTRY
ARMY
BRAT
WINDY
CITY
ADAM'S
RIB
WASHINGTON
CAPITALS
ANNIE
HALL
WEST
BERLIN
BACKBONE

WHERE THERE'S
SMOKE THERE'S FIRE
ALIEN
NATION
VANCOUVER
CANUCKS
KEITH
MOON
LITTLE ROCK,
ARKANSAS
KNEE
BRACE
KNUCKLE
SANDWICH

HOFFMAN
YELLOW
TAIL DAM
ACID
RAIN
YOUNG WENCHES
MAKE OLD WENCHES
60
MINUTES
WRESTLING
MAT
AGATHA
CHRISTIE
WONDER
CAVE
AFTERGLOW

YOU MADE YOUR BED
NOW LIE IN IT
A FISH
CALLED WANDA
WIND
SPRINT
ANDY ROONEY
WHITE CLOUD,
MICHIGAN
ASSEMBLY
LINE
WIN ONE
FOR THE GIPPER
AGAINST
ALL ODDS
WARM-UP
JACKET
ANTHONY
PERKINS
WELSH,
LOUISIANA
BACON, LETTUCE AND
TOMATO SANDWICH
WHERE THERE'S A
WILL, THERE'S A WAY
ALL
SHOOK UP
UTAH
JAZZ
KERMIT
THE FROG
LINEN
CLOSET
KNUCKLE
BALL
KNOW WHEN
TO QUIT

LINCOLN
X-RAY
LAB
ACORN
SQUASH
YOUNG AT
HEART
A BRIDGE
TOO FAR
WORLD BOXING
ASSOCIATION
AIR TRAFFIC
CONTROLLER
WISCONSIN
DELLS
AGENT
ORANGE
YOU DON'T HAVE
A LEG TO STAND ON
A FISTFUL
OF DOLLARS
WIN, PLACE
AND SHOW
ANGIE DICKENSON
WHITE BIRD,
IDAHO
ATOMIC
BOMB
WIDE-EYED

AGNES
OF GOD
WAR
GAMES
ANTHONY
QUINN
WELCH,
WEST VIRGINIA
BAGPIPES

WHEN IT RAINS,
IT POURS
ALL THE
PRESIDENT'S MEN
UPPER
DECK
KEITH
RICHARDS
LITTLE
BIG HORN
KNOTHOLE

KNOW WHEN
TO SAY WHEN

ANT
WORLDS
OF FUN
ACOUSTIC
GUITAR
YOU'VE GOT TO
HAND IT TO HIM
A CLOCKWORK
ORANGE
WIPE-OUT

AL
CAPONE
WINTERVILLE MOUNDS
STATE PARK
AIRCRAFT
CARRIER
YOU
DIRTY RAT
A FORCE
OF ONE
WILD
PITCH
ANN LANDERS
WET-N-WILD

ATTIC
FAN
WIDE-AWAKE

ALEXANDER
THE GREAT
VOLLEYBALL

ARCHIE
BUNKER
WEBB,
MISSISSIPPI
BAIT
CASTER
WHAT'S DONE
IS DONE
AMAZING
GRACE
UPLAND
GAME
KIM
BASINGER
LINDA HALL
LIBRARY
KOSHER
DILL PICKLES
KNOCK ON
WOOD

-continued

O CANADA

MINNESOTA
TIMBERWOLVES
KIM
HUNTER
LINCOLN'S TOMB,
ILLINOIS
LABOR
UNION
KNEE HIGH
TO A GRASSHOPPER

OH
SUSANNA
MID-AMERICAN
CONFERENCE
TOM PETTY &
THE HEARTBREAKERS
BAVARIAN
INN
UNEMPLOYMENT
INSURANCE
AHEAD OF
ITS TIME
WAR OF THE
WORLDS
BAREFOOT
SKIING
TOWN
CRYER
BARNWELL,
SOUTH CAROLINA
VANILLA
BEAN
ACTIONS SPEAK LOUD-
ER THAN WORDS
WEDDING BELL
BLUES
BALANCE
BEAM
THE BLUES
BROTHERS
BRYAN,
OHIO
TABLECLOTH

BANKER'S
HOURS
THEY CALL ME
MR. TIBBS!
BUCKTAIL

THE FABULOUS

O COME
ALL YE FAITHFUL
MINNESOTA
GOLDEN GOPHERS
KING
ARTHUR
LINCOLN
PARK
LACE
PANTIES
KISSIN'
COUSINS

OLD
YELLER
MICHIGAN
WOLVERINES
TOM
THUMB
BATTLESHIP
COVE
UNITED
AIRLINES
AGE BEFORE
BEAUTY
WASTED DAYS
AND WASTED NIGHTS
BARBELL

TRUMAN
CAPOTE
BAPTISM RIVER
STATE PARK
VANITY
MIRROR
ACT
YOUR AGE
WELCOME BACK,
KOTTER
BAIT
CASTER
THE BOSTON
POPS
BRUSH,
COLORADO
TAIL
SECTION
BANG ZOOM
TO THE MOON
THEY DIED WITH
THEIR BOOTS ON
BROWN
TROUT
THE FINE YOUNG

OCTOPUSSY

MILWAUKEE
BUCKS
KING
LEAR
LIMA,
MONTANA
LAMP
SHADE
KISS AND
MAKE UP

OLIVER
TWIST
MIAMI
HURRICANES
TONY
BENNETT
BATTLE CREEK,
MICHIGAN
UNIVERSAL
JOINT
AGAINST THE
GRAIN
WATERSHIP
DOWN
BANK
SHOT
TWEETY
BIRD
BANGOR INTER-
NATIONAL AIRPORT
VEGETABLE
GARDEN
ACE IN
THE HOLE
WEST SIDE
STORY
BACKSWING

THE BOY
WONDER
BRUNSWICK,
GEORGIA
TAP
DANCE
BALL OF
FIRE
THEY SHOOT HORSES
DON'T THEY
BRONZE
MEDAL
THE GRATEFUL

OF MICE
AND MEN
MIGRATORY BIRD
FLYWAY
KIRK
CAMERON
LIBRARY
OF CONGRESS
LANDFILL

KING OF
THE CASTLE

ON GOLDEN
POND
MIAMI
DOLPHINS
TONY
DOW
BATH,
MAINE
UNSALTED
BUTTER
AFTER WHILE,
CROCODILE
THE WAY WE
WERE
BALTIMORE
ORIOLES
ULYSSES
S. GRANT
BALD
KNOB
VIRGIN
WOOL
ABSENT
WITHOUT LEAVE
WHATEVER WILL BE,
WILL BE
BACKBOARD

THE CHESHIRE
CAT
BRUCE,
MISSISSIPPI
TAPE
DECK
BAKER'S
DOZEN
THIS GUN
FOR HIRE
BROKEN FIELD
RUN
THE HONEY

ODE TO
BILLY JOE
MILWAULKEE
BUCKS
KIRK
DOUGLAS
LIBERTY
COPPER PIT
LAP
DOG
KING
FOR A DAY

ON THE
ROAD AGAIN
METAL
WOOD
TONY
THE TIGER
BASS
PRO SHOPS
VACUUM
CLEANER
ADD INSULT
TO INJURY
WE GOT
THE BEAT
BALL
RETURN
UNCLE
SAM
BAKERSFIELD,
CALIFORNIA
VODKA
AND SQUIRT
ABSENCE MAKES THE
HEART GROW FONDER
WHEN HARRY
MET SALLY
BACK
COURT
THE CISCO
KID
BROWNSVILLE,
TENNESSEE
TASTE
BUDS
BAIT AND
SWITCH
THIS IS YOUR
LIFE
BRITISH
OPEN
THE HUDSON

OFF THE
WALL
MIDGET
CARS
KNIGHTS OF THE
ROUND TABLE
LIBBY,
MONTANA
LAVA
LAMP
KILLED THE GOOSE
THAT LAID THE GOLDEN
EGG
ON THE
WATERFRONT
MATCH
POINT
TOP
CAT
BARROW,
ALASKA
VALVE
STEM
ADD FUEL
TO THE FIRE
WE'VE ONLY
JUST BEGUN
BALL
MARKER
UNDER
DOG
BAGGS,
WYOMING
VOTER'S
REGISTRATION CARD
ABOVEBOARD

WHEN YOU WISH
UPON A STAR
AUTO
RACING
THE EASTER
BUNNY
BROOKFIELD
ZOO
TEA
KETTLE
BAG OF
TRICKS
THIS OLD
HOUSE
BREEDER'S CUP
CLASSIC
THE HUNCHBACK

-continued

| | | | | | |
|---|---|---|---|---|---|
| THUNDERBIRDS | CANNIBALS | DEAD | DRIPPERS | BROTHERS | OF NOTRE DAME |
| BROKEN ARROW, OKLAHOMA | BRADSHAW, WEST VIRGINIA | BOYS TOWN | BOWLING GREEN, KENTUCKY | BOWIE, MARYLAND | BOWBELLS, NORTH DAKOTA |
| TEAR | TEDDY | TEETHING | TELEPHONE | TENNIS | TENT |
| SHEET | BEAR | RING | CORD | BRACELET | STAKE |
| BAD TO | BAD | BACK-TRACK | BACK-BREAKER | BACK OFF, | BABIES |
| THE BONE | EGG | | | MAN | MUST PLAY |
| THREE COINS IN THE FOUNTAIN | THREE DAYS OF THE CONDOR | THRILL IS GONE | THROW MAMA FROM THE TRAIN | THUNDERBOLT AND LIGHTFOOT | TICKET TO RIDE |
| BREAST STROKE | BOXING GLOVES | BOX SEATS | BOWLING ALLEY | BOUNCE PASS | BOSTON RED SOX |

We claim:

1. A method of playing a word association game, consisting of a game board defining a FIG. 8 shaped track having a plurality of color coded spaces with a labeled starting space at the enter of the board, game pieces, a die, a resetable timer, score pads, writing instruments, a deck of cards with color coded word sets having words, comprising the steps of:

selecting a game piece;

rolling a die;

moving said game piece from the center starting space along the track a number of spaces corresponding to the die roll;

selecting a card from said deck of cards;

selecting a color coded word set corresponding to the color coded space onto which the game piece was moved;

recording said word set onto a score pad;

starting said timer;

creating and recording a sequence of word sets using one or more word elements from a preceding word set until the timer runs out; and scoring the word sets created and recorded during a turn.

2. The method of playing a word association game of claim 1, further comprising the step of recording the credit toward winning for the number of created and recorded word sets in the sequence.

3. The method of playing a word association game of claim 2, wherein said color coded spaces define different categories by having all of the word sets of each category associated with a different color coding.

4. The method of playing a word association game of claim 3, wherein a created and recorded word set is scored only if the word set is commonly known to a majority of players.

5. The method of playing a word association game of claim 4, wherein a created and recorded word set is not scored if the word set is repetitive of any preceding word set.

* * * * *